US007517306B2

(12) United States Patent
Fisher et al.

(10) Patent No.: US 7,517,306 B2
(45) Date of Patent: Apr. 14, 2009

(54) HIP PUMP ASSEMBLY

(75) Inventors: Martin J. Fisher, San Francisco, CA (US); Muhamed Swaleh, Malindi (KE); Alan Charles Spybey, Nairobi (KE); Frederick Obudho, Nairobi (KE)

(73) Assignee: KickStart International, Inc., San Francisco, CA (US)

( * ) Notice: Subject to any disclaimer, the term of this patent is extended or adjusted under 35 U.S.C. 154(b) by 0 days.

(21) Appl. No.: 11/665,309

(22) PCT Filed: Oct. 12, 2005

(86) PCT No.: PCT/US2005/036636

§ 371 (c)(1),
(2), (4) Date: Oct. 10, 2007

(87) PCT Pub. No.: WO2006/042264

PCT Pub. Date: Apr. 20, 2006

(65) Prior Publication Data

US 2008/0039300 A1 Feb. 14, 2008

Related U.S. Application Data

(60) Provisional application No. 60/617,891, filed on Oct. 12, 2004.

(51) Int. Cl.
*A63B 21/008* (2006.01)

(52) U.S. Cl. ..... 482/112; 482/92; 482/113

(58) Field of Classification Search ..... 482/1–9, 482/51–54, 66, 72, 73, 92, 111–113
See application file for complete search history.

(56) References Cited

U.S. PATENT DOCUMENTS

| | | | | |
|---|---|---|---|---|
| 5,000,441 | A * | 3/1991 | Wang | 482/51 |
| 5,299,994 | A * | 4/1994 | Chen | 482/52 |
| 5,346,452 | A * | 9/1994 | Ku | 482/113 |
| 5,890,996 | A * | 4/1999 | Frame et al. | 482/8 |
| 6,241,643 | B1 * | 6/2001 | Loft et al. | 482/114 |
| 7,097,593 | B2 * | 8/2006 | Chang | 482/54 |

* cited by examiner

*Primary Examiner*—Glenn Richman
(74) *Attorney, Agent, or Firm*—Goodwin Procter LLP

(57) ABSTRACT

Provided herein is an innovative human powered pumping device comprising a piston and cylinder pumping mechanism that is hinged off a base. In use, the piston is driven in and out of the cylinder by a handle which is pushed and pulled by the operator. The base is resting on the ground and the cylinder is hinged off the base such that the pumping mechanism can rotate with respect to the base during the pumping motion.

6 Claims, 37 Drawing Sheets isometric plan rear elevation side elevation one method of using the HipPump

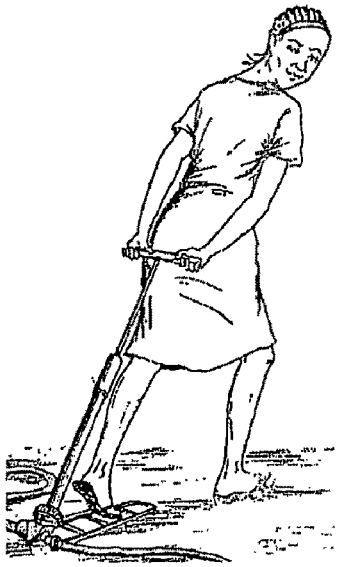
Fig 7
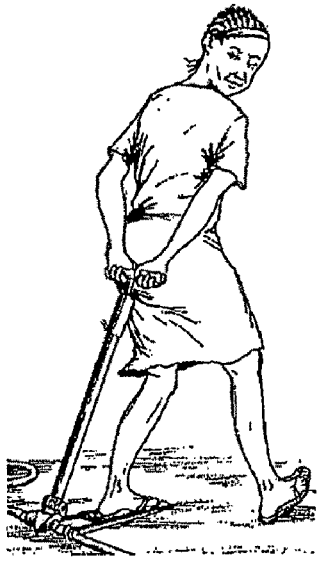
Fig 8
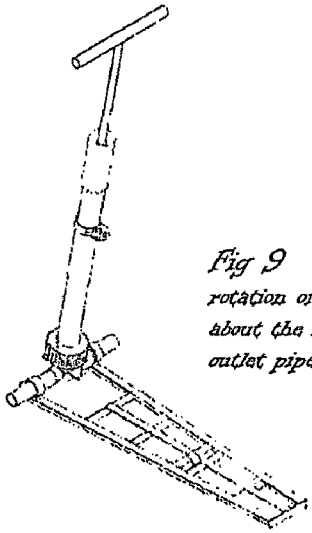
Fig 9
rotation of the cylinder about the inlet and outlet pipes.
Fig 10
close up of rotating base
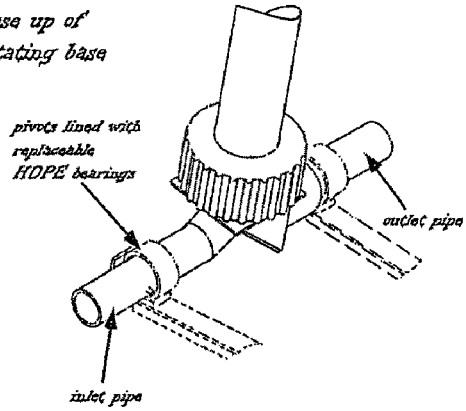
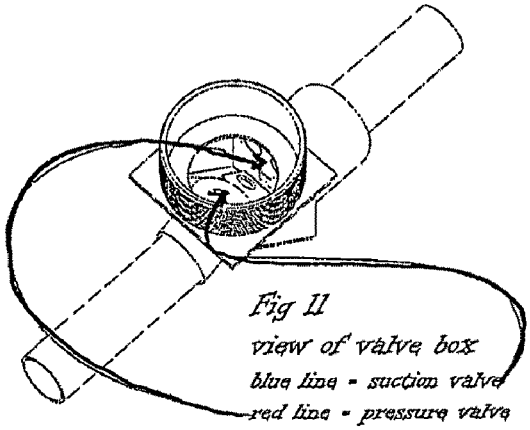
Fig 11
view of valve box
blue line = suction valve
red line = pressure valve
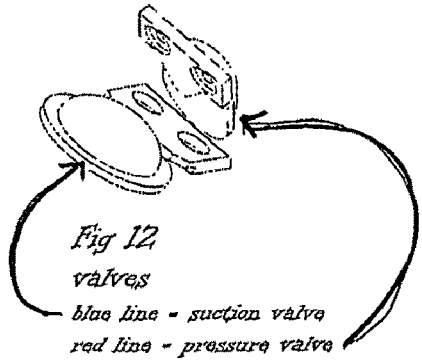
Fig 12
valves
blue line = suction valve
red line = pressure valve side section of valve box: suction valve in operation bolts holding on the valve chamber on another design of human-powered irrigation pump.

schematic illustration of how screws is usually obtained to place the outlet valve.

outlet valve in resting position outlet valve in open position

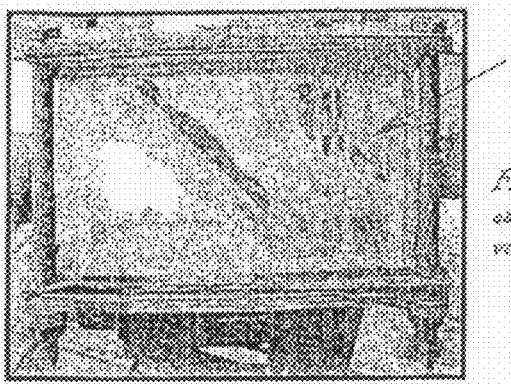
Fig 18
early prototype of outlet valve in test equipment.
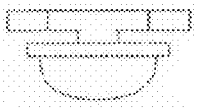
Fig 19
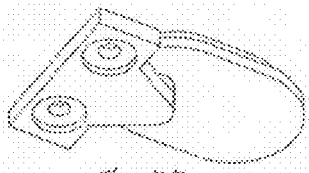
Fig 22
isometric
Figs 19-23
views of present manifestation of outlet valve
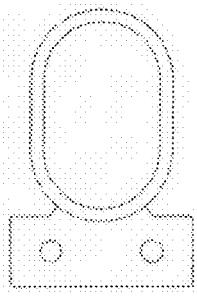
Fig 20
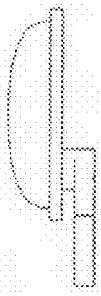
Fig 21
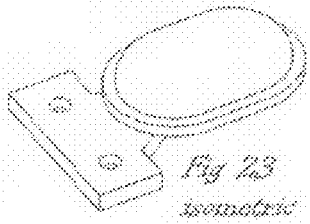
Fig 23
isometric
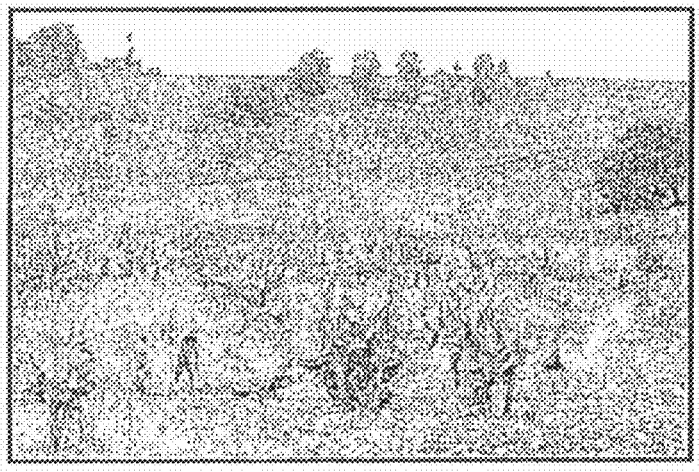
Fig 24
A distant shot of the HipPump in operation. The man second from left is pumping water from a stream while the man on the right directs the spray of water onto crops through a nozzle.

insertion
mode of oral
valve section through the
valve box when piston
is at inrest position blue hatched area
shows the volume
under the piston when
at inrest position.

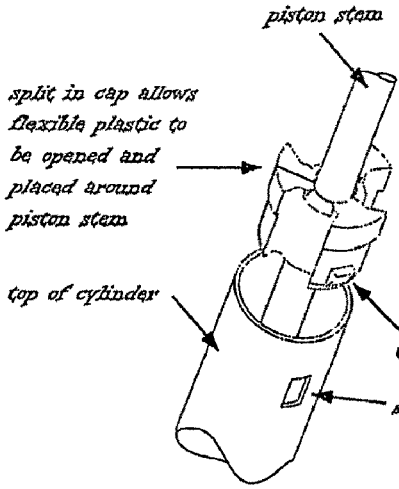
Fig 28
Insertion of Cylinder Cap.
Fig 29
Cylinder Cap - cavity behind tapered tab (viewed from under).
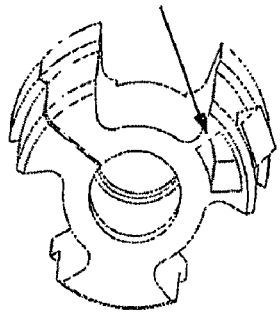
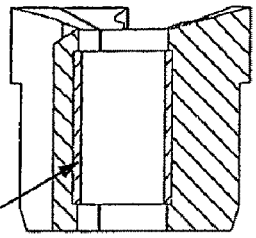
Fig 30
Cylinder Cap - replaceable liner
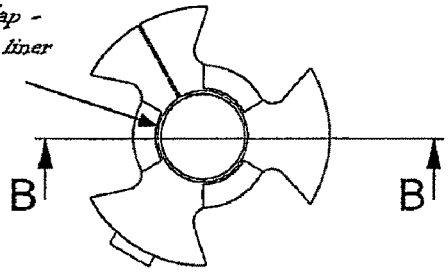
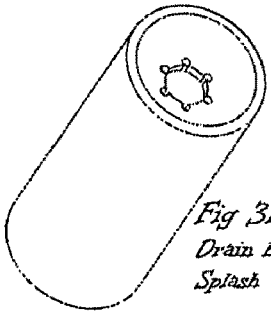
Fig 31
Drain holes in Splash Cap
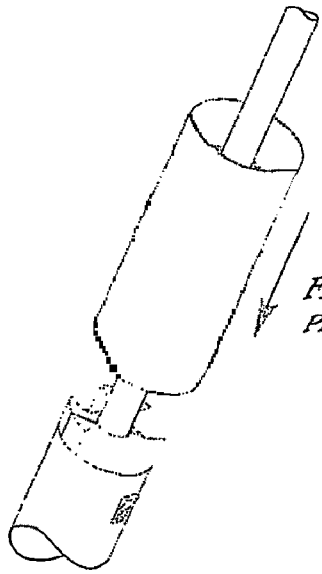
Fig 32
Placing Splash Cap Path for water flow through Splash Cap and Cylinder Cap when priming pump Redirection of water by the Splash Cap Screw-on valve for attaching cylinder to valve box.

Opposed piston seals

Leak Valve hole in upper piston disk

Air escaping through the leak hole on the downward stroke.

Leak valve closing as inter-seal space is filled with water.

EXEMPLARY MATERIALS LIST FOR STEEL AND PVC COMPONENTS

| ITEM NO. | QTY. | DESCRIPTION | SECTION | LENGTH | DIM | TYPE | MATERIAL |
|---|---|---|---|---|---|---|---|
| 1 | 1 | FrontFlatBar | 20x3 | 111 | @ | FB | MS |
| 2 | 2 | SideTEE | 20x20x3 | 725 | @ | Tee | MS |
| 3 | 1 | FrntFlatBarBack | 20x3 | 144 | @ | MS | MS |
| 4 | 1 | FrntFlatBar1 | 20x3 | 128 | @ | FB | MS |
| 5 | 1 | FrntFlatBar2 | 20x3 | 122 | @ | FB | MS |
| 6 | 1 | FrntFlatBar3 | 20x3 | 105 | @ | FB | MS |
| 7 | 1 | FrntFlatBarCloset | 20x3 | 160 | @ | FB | MS |
| 8 | 1 | TopFlat_1 | 20x3 | 268 | @ | FB | MS |
| 9 | 1 | CentreFlatBar | 20x3 | 293 | @ | FB | MS |
| 10 | 2 | ModeSpacer | 25x6 | 20 | @ | FB | MS |
| 11 | 2 | bush | D42 x3 | 20 | @ | 11/4' BP C | MS |
| 12 | 1 | SHS60Pump_Base | 60x60x2 | 60 | @ | SHS | MS |
| 13 | 1 | SHS60Pump_SuctionValvePlateMOD | 3 | 83 | @ | PL | MS |
| 14 | 1 | SHS60Pump_TopPlate | 3 | 75 | @ | PL | MS |
| 15 | 1 | SHS60Pump_2.5Nipple | D75x3.25 | 30 | @ | 21/2" BP B | MS |
| 16 | 1 | SHS60PumpSwaged_PressureHousing | D49x1.5 | 50 | @ | @ | RST |
| 17 | 1 | SHS60PumpSwaged_PressurePipe | D27x2.65 | 85 | @ | 3/4"BP A | MS |
| 18 | 4 | SHS60Pump_Pin | D6 | 11 | @ | Dome Rivet | MS |
| 19 | 1 | SuctionValve | @ | @ | @ | STD Part | PVC 35 C |
| 20 | 1 | RHS75Pump_SuctionPipeBendMOD | D34x3 | 50 | @ | 1" BP B | MS |
| 21 | 1 | SHS75Pump_SuctionPipeMod | D27x2.65 | 125 | @ | 3/4"BP A | MS |
| 22 | 2 | HPBearingStopper | D4 | 6 | @ | RB | MS |
| 23 | 1 | VerticalStopper | 25x25x3 | 25 | @ | Al | MS |
| 24 | 1 | PressureValveMode | @ | @ | @ | SupliedPart | PVC 35 C |
| 25 | 1 | HPHandleColumn | D16x1.5 | 670 | @ | RST | MS |
| 26 | 1 | HPHandleArm | D25x2 | 280 | @ | BPClassA | MS |
| 27 | 2 | HPSmallWasher | 2 | @ | 37x37 | PL | MS |
| 28 | 2 | HPLargeWasher | 2 | @ | 43x43 | PL | MS |
| 29 | 2 | HPhingedPistonCup | @ | @ | @ | STD Part | PVC |
| 30 | 1 | PistonSeal | 2 | @ | 16x16 | PL | MS |
| 31 | 1 | FlashCap | @ | 180 | @ | STD Part | PVC |
| 32 | 1 | NewCylinder | D50x2 | 630 | @ | PVC Class C | PVC |
| 33 | 1 | CylinderCollar | @ | @ | @ | Supplied Part | PVC |
| 34 | 1 | CylinderGasket | Supplied Part | @ | @ | @ | PVC 35 C |
| 35 | 1 | BarrelNippleCap | @ | @ | @ | STD Part | PVC |
| 36 | 1 | HPClip | @ | @ | @ | STD Part | PVC |
| 37 | 2 | HDPEBearing | D36x4 | 20 | @ | HDPE 6 Bar | HDPE |
| 38 | 1 | betaHPCylinderCap | @ | @ | @ | Supplied Part | PVC |
| 39 | 1 | CylinderCapHDPE | D20 | 30 | @ | 6 Bar HDPE | HDPE |

KickStart
The Tools to End Poverty
P O BOX 64142
NARIROBI

HIP PUMP

UNLESS OTHERWISE SPECIFIED:
DIMENSIONS ARE IN MILLIMETERS:

Bom_HipPump
Hip_PumpComplete

SCALE:1:1
3rd Angle Projection

FIG. 40

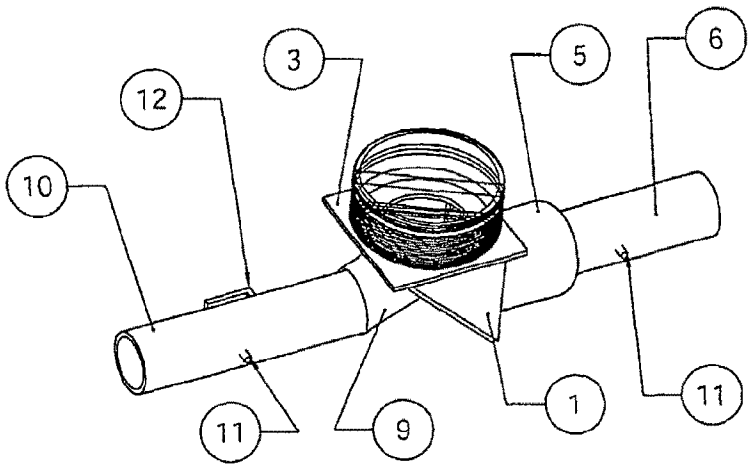

| ITEM NO. | QTY. | DESCRIPTION | SECTION | LENGTH | DIM | TYPE | MATERIAL |
|---|---|---|---|---|---|---|---|
| 1 | 1 | SHS60Pump_Base | 60x60x2 | 60 | @ | SHS | MS |
| 2 | 1 | SHS60Pump_SuctionValvePlateMOD | 3 | 83 | @ | PL | MS |
| 3 | 1 | SHS60Pump_TopPlate | 3 | 75 | @ | PL | MS |
| 4 | 1 | SHS60Pump_2.5Nipple | D75x3.25 | 30 | @ | 21/2" BP B | MS |
| 5 | 1 | SHS60PumpSwaged_PressureHousing | D49x1.5 | 50 | @ | @ | RST |
| 6 | 1 | SHS60PumpSwaged_PressurePipe | D27x2.65 | 85 | @ | 3/4"BP A | MS |
| 7 | 4 | SHS60Pump_Pin | D6 | 11 | @ | Dome Rivet | MS |
| 8 | 1 | SuctionValve | @ | @ | @ | STD Part | PVC 35 C |
| 9 | 1 | RHS75Pump_SuctionPipeBendMOD | D34x3 | 50 | @ | 1" BP B | MS |
| 10 | 1 | SHS75Pump_SuctionPipeMod | D27x2.65 | 125 | @ | 3/4"BP A | MS |
| 11 | 2 | HPBearingStopper | D4 | 6 | @ | RB | MS |
| 12 | 1 | VerticalStopper | 25x25x3 | 25 | @ | AI | MS |
| 13 | 1 | PressureValveMode | @ | @ | @ | SupliedPart | PVC 35 C |

KickStart
The Tools to End Poverty
P O BOX 64142
NAIROBI

HIP PUMP

UNLESS OTHERWISE SPECIFIED:
DIMENSIONS ARE IN MILLIMETERS:

BomPumpBody
Hip_PumpComplete

SCALE:1:3
3rd Angle Projection

FIG. 42

Part No 3,5 and 9
J
75
38
Φ46
3
J-J (1 : 1.5)
Part No 3 Punched Diameter 46mm Hole
Φ48
50
D-D (1 : 1.5)
Part No 5
D
Φ29
Part No 5 Pipe RST Diameter 50 swaged to shape.Scale 1:2
Φ34
N-N
42
17
N
Φ27
Part No 9 .BPA 1" pipe cut to shape
KickStart
The Tools to End Poverty
P O BOX 64142
NAIROBI
HIP PUMP
UNLESS OTHERWISE SPECIFIED:
DIMENSIONS ARE IN MILLIMETERS:
PumpBodyPartsDetails2
Hip_PumpComplete
SCALE:1:1.5
3rd Angle Projection

| ITEM NO. | QTY. | DESCRIPTION | SECTION | LENGTH | DIM | TYPE | MATERIAL |
|---|---|---|---|---|---|---|---|
| 1 | 1 | HPHandleColumn | D16x1.5 | 670 | @ | RST | MS |
| 2 | 1 | HPHandleArm | D25x2 | 280 | @ | BPClassA | MS |
| 3 | 2 | HPSmallWasher | 2 | @ | 37x37 | PL | MS |
| 4 | 2 | HPLargeWasher | 2 | @ | 43x43 | PL | MS |
| 5 | 2 | HPhingedPistonCup | @ | @ | @ | STD Part | PVC |
| 6 | 1 | PistonSeal | 2 | @ | 16x16 | PL | MS |
| 7 | 1 | FlashCap | @ | 180 | @ | STD Part | PVC |

Piston Parts

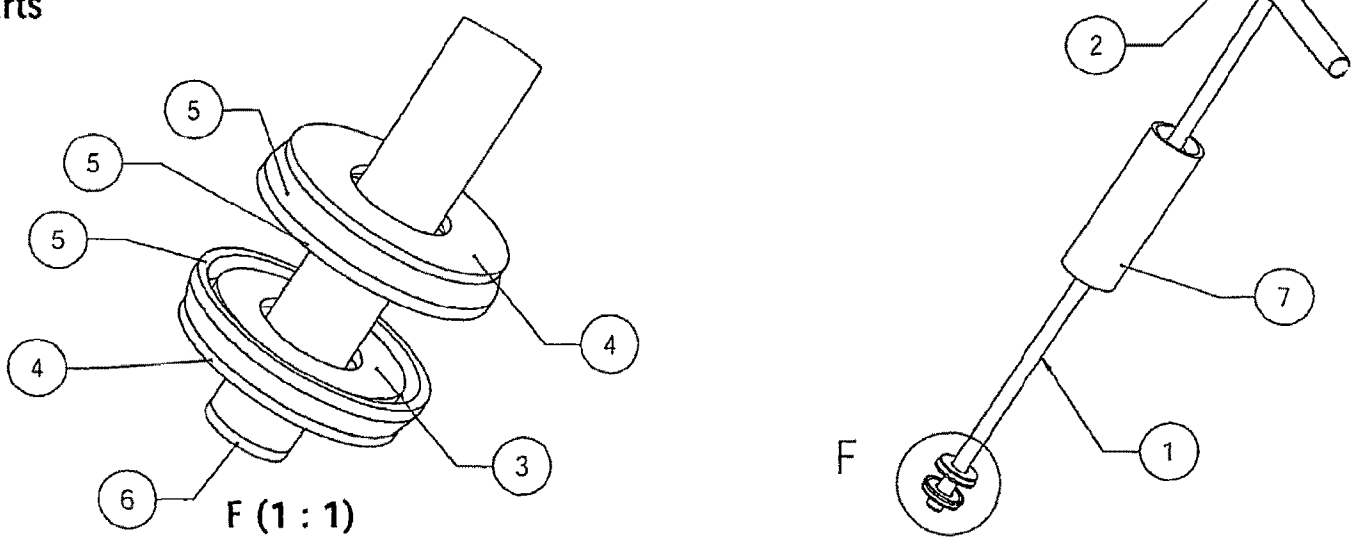

KickStart
The Tools to End Poverty
P O BOX 64142
NAIROBI

HIP PUMP

UNLESS OTHERWISE SPECIFIED:
DIMENSIONS ARE IN MILLIMETERS:

Bom Piston
Hip_PumpComplete

SCALE:1:6
3rd Angle Projection

FIG. 48

Hip pump Filter

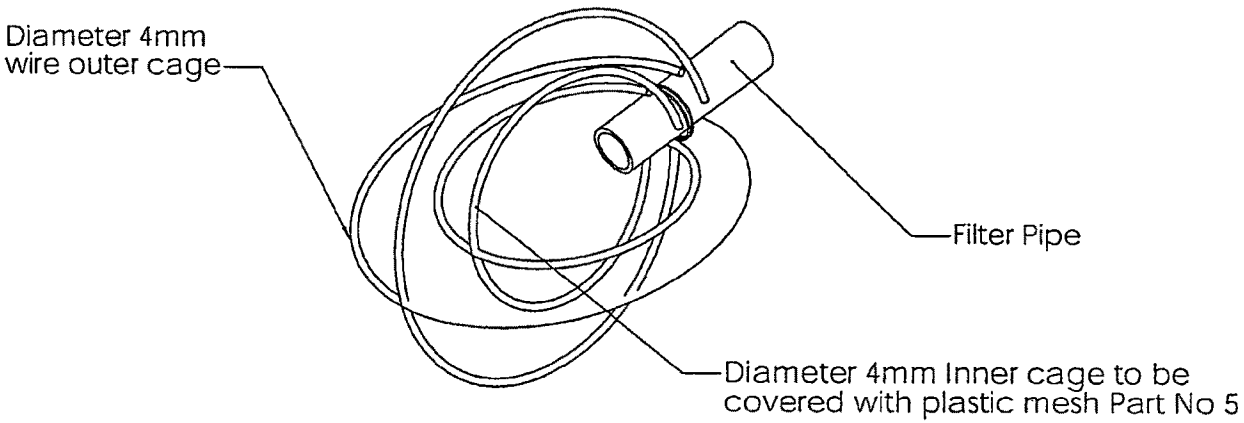

| ITEM NO. | QTY. | DESCRIPTION | SECTION | LENGTH | DIM | TYPE | MATERIAL |
|---|---|---|---|---|---|---|---|
| 1 | 1 | HPFilterBP'A'3_4pipe | D27x2.65 | 100 | @ | 3/4"BP A | MS |
| 2 | 2 | HPfilter4mmwire | D4 | 420 | @ | RB | MS |
| 3 | 1 | HPfilter1mmwire | D1 | 250 | @ | BindingWire | MS |
| 4 | 2 | HPfilter4mmOuterwire | D4 | 630 | @ | RB | MS |
| 5 | 1 | ShadeNetFilter | @ | @ | 350x350 | 50percentProof | PVC |

KickStart
The Tools to End Poverty
P O BOX 64142
NAIROBI

HIP PUMP

UNLESS OTHERWISE SPECIFIED:
DIMENSIONS ARE IN MILLIMETERS:

HipPumpFilter
Hip_PumpComplete

SCALE:1:3
3rd Angle Projection

FIG. 50

SECOND EMBODIMENT OF HIP PUMP ASSEMBLY

Hip Pump Drawings Legend

| Abbreviation | Meaning |
|---|---|
| HP | Hip pump |
| MS | Mild steel |
| GI | Galvanized cast iron |
| RBR | Rubber |
| PVC | poly vinyl chloride |
| FB | Flat bar |
| RST | Round steel tube (pipe) |
| PL | Plate |
| BP | Black pipe |
| RB | Round bar |
| STD | Standard |
| TS | "T"-section |

FIG. 52

| ITEM NO. | QTY. | DESCRIPTION | SECTION | LENGTH | MATERIAL |
|---|---|---|---|---|---|
| 1 | 1 | HPCylinderBase_ASSEMBLY | | | |
| 2 | 1 | HPSuctionValve_ASSEMBLY | | | |
| 3 | 1 | HPPressureValve_ASSEMBLY | | | |
| 4 | 1 | HPPressureOutlet_ASSEMBLY | | | |
| 5 | 1 | HP32BallRetainer_ASSEMBLY | | | |
| 6 | 1 | HPSuctionPipe | D38x1.50 | 70 | MS |
| 7 | 1 | HPHalfGI | D55.50x5 | 25 | GI |
| 8 | 1 | HPCylinder_ASSEMBLY | | | |
| 9 | 1 | HPHandleAssembly | | | |
| 10 | 1 | HPFootPlate_ASSEMBLY | | | |

AQ (1 : 2)
I (1 : 2)
AQ
I
5
N
7
H-H (1 : 7)
H
H
N (1 : 2)
SECOND EMBODIMENT OF
HIP PUMP ASSEMBLY
HAND PUMP BALL VALVE
HP_ASSEMBLY
(HandPumpViews)
Scale: 1:1

| ITEM NO. | QTY. | DESCRIPTION | SECTION | LENGTH | DIM | TYPE | WLEN | MATERIAL |
|---|---|---|---|---|---|---|---|---|
| 1 | 1 | base | 50 x 3 | 50 | @ | FB | @ | MS |
| 2 | 1 | CylinderBase | D48.25x1.5 | 58 | @ | RST | @ | MS |
| 3 | 2 | FlatBar1 | 30 x 3 | 40 | @ | FB | @ | MS |
| 4 | 1 | CylinderBaseUp | D48.25x1.5 | 95 | @ | RST | @ | MS |
| 5 | 1 | dish | R21x2.50 | @ | @ | PL | @ | @ |
| 6 | 1 | 32ball | SP16 | @ | @ | @ | @ | RBR |
| 7 | 1 | MediumPipe2 | D38x1.50 | 80 | @ | @ | @ | MS |
| 8 | 1 | Dish25 | R17 | @ | @ | PL2.50 | @ | MS |
| 9 | 1 | 25ball | SP 12.50 | @ | @ | @ | @ | RBR |
| 10 | 1 | PipeInsert | D26.65x2 | 70 | @ | BP Class C | @ | MS |
| 11 | 1 | PipePacking | D33.80x3.25 | 20 | @ | PB Class C | @ | MS |
| 12 | 1 | HP25BallRetainer | D4 | 33 | @ | RB | @ | MS |
| 14 | 1 | 32BallRetainerRing | D4 | D20x2 | @ | RB | @ | MS |
| 16 | 2 | 32BallGuideSupport | D4 | 85 | @ | RB | @ | MS |
| 17 | 1 | RetainerSupport | D4 | 36 | @ | RB | @ | MS |
| 19 | 1 | HPSuctionPipe | D38x1.50 | 70 | @ | RST | @ | MS |
| 20 | 1 | HPHalfGI | D55.50x5 | 25 | @ | STD Part | @ | GI |

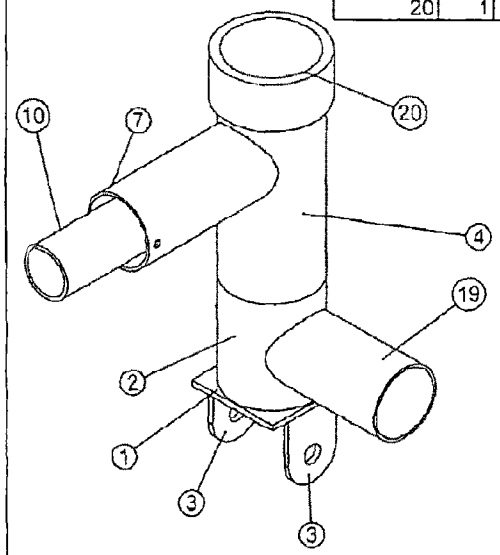

SECOND EMBODIMENT OF
HIP PUMP ASSEMBLY

| HAND PUMP BALL VALVE | HP_ASSEMBLY (HPBase_ASSEMBLY) |
|---|---|
| Scale: 1:1 | FIG. 55 |

M
M
M-M (1 : 2.3)
HAND PUMP BALL VALVE
HP ASSEMBLY
(HPBase Views)
Scale: 1:1

SECOND EMBODIMENT OF
HIP PUMP ASSEMBLY

S
S
7.74
S-S (1 : 2)
R24.13
R22.63
R-R (1 : 2)
25
R
R
95
PART NO 4
SECOND EMBODIMENT OF
HIP PUMP ASSEMBLY
+0.10
-0.10
Ø44.50
P
P
+0.25
0
Ø25
30°
2.50
P-P
PART NO 5
HAND PUMP BALL VALVE
HP ASSEMBLY
(HPSuctionValve)
Scale: 1:1

X
X
8.44
X-X (1 : 1.3)
ISOMETRIC
80
75
W
W
Ø4
W-W (1 : 1.4)
PART NO 7
+0.10
-0.10
Ø36.50
U
U
+0.25
0
Ø21.50
30°
2.50
U-U (1.5 : 1)
PART NO 8
SECOND EMBODIMENT OF
HIP PUMP ASSEMBLY
HAND PUMP BALL VALVE
HP ASSEMBLY
(HPPressureValve)
Scale: 1:1

9.13
0.88
44
0.88
SECOND EMBODIMENT OF
HIP PUMP ASSEMBLY
Ø48.25
24.13
28
58
Ø38
PART NO 2
25
R15
30
15
Ø10
PART NO 3
HAND PUMP BALL VALVE
HP ASSEMBLY
(HPCylinderBase)
Scale: 1:1

85
38
40
Ø45
PART NO 14
SECOND EMBODIMENT OF
HIP PUMP ASSEMBLY
HAND PUMP BALL VALVE
HP ASSEMBLY
(SuctionBallRetainer)
Scale: 1:1

PART

| ITEM NO. | QTY. | DESCRIPTION | SECTION | LENGTH | DIM | TYPE | WLEN | MATERIAL |
|---|---|---|---|---|---|---|---|---|
| 1 | 1 | HPHandleColumn | D16x1.50 | 620 | @ | RST | @ | MS |
| 2 | 1 | HPHandleArm | D29x2 | 280 | @ | BPClassA | @ | MS |
| 3 | 2 | HPLargeWasher | 2 | @ | 43x43 | PL | 43x43 | MS |
| 4 | 2 | HPSmallWasher | 2 | @ | 38.50x3.50 | | @ | MS |
| 5 | 1 | HPCylinderCap | @ | @ | @ | STD Part | @ | PVC |
| 6 | 2 | HPhingedPistonCup | @ | @ | @ | STD Part | @ | PVC |

SECOND EMBODIMENT OF HIP PUMP ASSEMBLY

AH
AH
Ø43
Ø20
2
AH-AH
PART NO 3
AJ
AJ
Ø38.50
Ø20
2
AJ-AJ
PART NO 4
SECOND EMBODIMENT OF
HIP PUMP ASSEMBLY
AF
AF
18.43°
0.52
2.50
2
Ø43
25
AF-AF (2 : 1)
Ø42
Ø46
ØR1.25
2.33
4.50
PART NO 6
HAND PUMP BALL VALVE
HP ASSEMBLY
(HPHandlePartsDetail)
Scale: 1:1

| ITEM NO. | QTY. | DESCRIPTION | SECTION | LENGTH | DIM | TYPE | WLEN | MATERIAL |
|---|---|---|---|---|---|---|---|---|
| 1 | 1 | HPPVCNipple | D48x4 | 45 | @ | ClassE | @ | PVC |
| 2 | 1 | HPCylinder | D25+25 | 564 | @ | ClassB | @ | PVC |

SECOND EMBODIMENT OF HIP PUMP ASSEMBLY

| ITEM NO. | QTY. | DESCRIPTION | SECTION | LENGTH | DIM | TYPE | WLEN | MATERIAL |
|---|---|---|---|---|---|---|---|---|
| 1 | 2 | FlatBar5 | 30 x 3 | 65 | @ | FB | @ | MS |
| 2 | 1 | Rod06 | 10 | 55 | @ | RB | @ | MS |
| 3 | 2 | FlatBent01 | 20x3 | =60+240+320 | @ | FB | @ | MS |
| 4 | 3 | Tee01 | 20x20x3 | 100 | @ | TS | @ | MS |
| 5 | 1 | FlatBar8 | 20x3 | 43 | @ | FB | @ | MS |
| 6 | 1 | Tee02 | 20x20x3 | 43 | @ | TS | @ | MS |

| | |
|---|---|
| HAND PUMP BALL VALVE | HP ASSEMBLY (HPFootPlate) |
| Scale: 1:1 | |

101
320.09
623.24
13.88°
238.24
79.91
50
35
37
SECOND EMBODIMENT OF
HIP PUMP ASSEMBLY
HAND PUMP BALL VALVE
HP ASSEMBLY
(HPFootPlateViews)
Scale: 1:1

240
6.94°
320.09
238.24
79.91
20
PART NO 4
R1.25
Ø10
Ø11
Ø11
55
1
PART NO 3
SECOND EMBODIMENT OF
HTP PUMP ASSEMBLY
50
30
Ø10
R15
PART NO 1
HAND PUMP BALL VALVE
Scale: 1:1
HP ASSEMBLY
(HPFootPlatePartsDetails)

HIP PUMP ASSEMBLY

CROSS-REFERENCE TO RELATED APPLICATIONS

This application is the U.S. national stage application of International (PCT) patent application Ser. No. PCT/US05/036636 , filed Oct. 12. 2005, which claims the benefit of priority to U.S. Application No. 60/617,891, filed Oct. 12, 2004. The entire disclosures of these two applications are incorporated herein by reference in their entirety.

STATEMENT REGARDING FEDERALLY SPONSORED RESEARCH OR DEVELOPMENT

Not applicable

REFERENCE OF A "MICROFICHE APPENDIX"

Not applicable

FIELD OF THE INVENTION

The present invention relates generally to pumping devices and more particularly to an innovative hip pump assembly and method of operating same.

BRIEF DESCRIPTION OF THE DRAWINGS

FIGS. 1-50 illustrate aspects of an exemplary embodiment of the hip pump assembly of the present invention in accordance with the teachings herein.

FIGS. 51-68 illustrate aspects of an alternative embodiment of the hip pump assembly of the present invention in accordance with the teachings herein.

DESCRIPTION OF THE INVENTION

The aspects, features and advantages of the present invention will become better understood with the following description and reference to the accompanying detailed drawings. What follows are preferred embodiments of the present invention. It should be apparent to those skilled in the art that they are illustrative only and not limiting, having been presented by way of example only. All the features disclosed in this description may be replaced by alternative features serving the same purpose, and equivalents or similar purpose, unless expressly stated otherwise. Therefore, numerous other embodiments of the modifications thereof are contemplated as falling within the scope of the present invention as defined herein and equivalents thereto.

I. FIGS. 1-50

As shown in FIGS. 1-4, the hip pump assembly of the present invention is a human powered pumping device comprising a piston and cylinder pumping mechanism that is hinged off a base. In use, the piston is driven in and out of the cylinder by a handle which is pushed and pulled by the operator. The base is resting on the ground and the cylinder is hinged off the base such that the pumping mechanism can rotate with respect to the base during the pumping motion.

Figure 1:
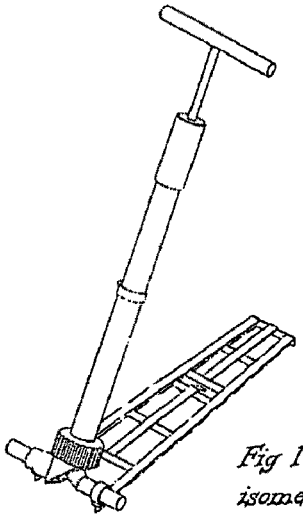
Figure 2:
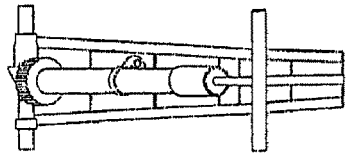
Figure 3:
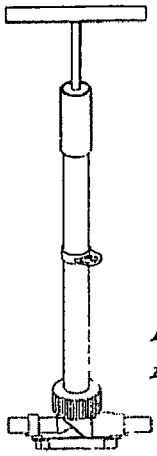
Figure 4:
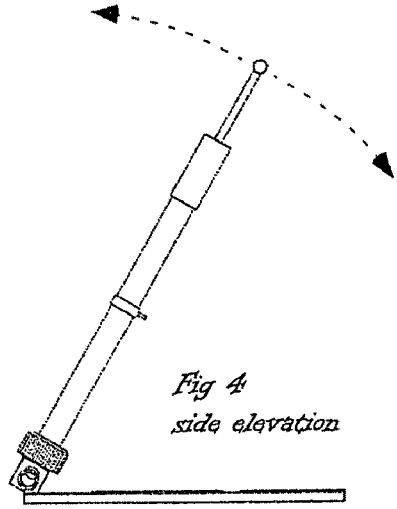
Figure 5:
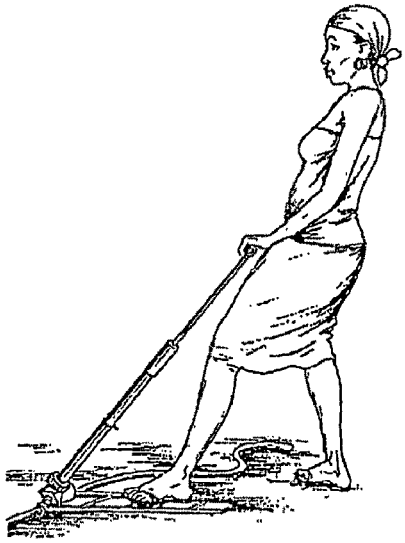
Figure 6:
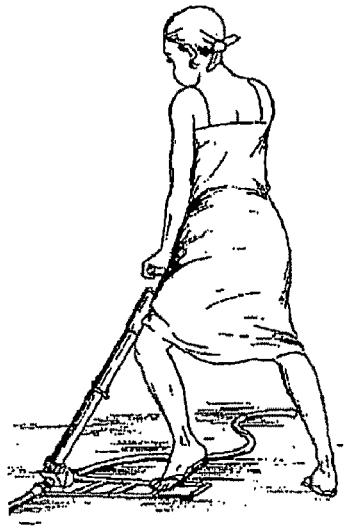

In an exemplary embodiment, the hip pump is designed for pumping liquids and the base of the pump is a narrow base which the user places either one or both feet on, and the pumping mechanism is pivoted off the other end of the base—out in front of, or to one side of, the user as indicated in FIGS. 5-6. The cylinder may be fairly long to minimize sideways wear. The piston is a low-friction-piston, such as one made with PVC or leather piston cups, or any other type of low friction piston. The base of the pump can be folded up against the pump and clamped in place with a flexible clip for easy transport. Optionally, the base can also unfold in either direction thereby minimizing wear on one side of the cylinder.

The invention is designed to be easy to operate for long periods without the user getting fatigued and to be easy to use and maintain. No training or technical knowledge is required to operate or to maintain the invention. With suitable piston and valves, this pumping mechanism could be used to pump any type of fluid or gas.

A. The Hinged Base

The piston and cylinder pumping mechanism is hinged off the pump's base, which lies on the ground during use. This unique design feature enables the pump to be used by the operator in a number of different ergonomic ways. These pumping methods, which are made possible by the hinged base, make effective use of the operator's leg muscles and weight and enable the operator to use the pump with greater ease, and for longer periods of time than are possible with other existing hand pump designs.

In use, the operator places one or both feet on the base, with his/her feet comfortably apart and the hinge in front of, or to the side of him/her. S/he grasps the handle of the pump in his/her hands and holds it firmly against his/her hips. S/he then rocks back and forth transferring a portion of his/her weight from one foot to the other. This rocking motion causes the user to move his/her hips thru a rough arc, approximately 6 to 10 inches in length, and as a result moves the handle in a similar arc and drives the piston in and out of the cylinder to pump the water. The cylinder rotates on the hinge so that it can accept this non-linear motion of the piston handle When the user is facing the pump, the rocking motion comprises small lunges or stepping movements. When the user is standing sideways to the pump, the rocking motion comprises sideways movement, shifting weight from one side to the other. Both lunging (stepping) and sideways movement, involves transmitting the user's weight from one foot to the other and this enables the user to transmit a lot of force to the pump handle in both the pushing and pulling directions. This larger force enables the hip pump's cylinder to be of a larger diameter than would be possible on a typical hand pump to pump more fluid on each stroke. In addition, this rocking motion is easy to do for a long period and the pump can be operated for long periods without tiring the user.

Users of the hip pump can also utilize a rowing motion in combination with the rocking of the hips. As the user rocks their hips back and forth, their arms are also moving in a circular motion (rowing motion) to operate the piston. Another stance which can be adopted involves pushing the pump handle with the rear of the body. (See FIGS. 7 & 8) The invention can also be used with a hip belt to assist the user with the pulling motion. The invention is flexible enough to accommodate many different usage styles—the benefit is that the invention can be used for long periods without tiring and in a manner that is comfortable for different users. In general, this invention is highly energy efficient because a user can incorporate the muscles of his/her whole body to use the pump. In particular, the operator consistently uses his/her legs which are the strongest and least quick to fatigue muscles in the body. Compared to pumps which use a person's arms to operate, this invention enables a user to pump for a longer duration since a person's arms have poor endurance compared to their legs. In particular, the level of effort to use this pump is substantially less than the effort required to use a similar cylinder and piston pump that does not have a pivoted base—such as a standard floor mounted bicycle pump.

In using such a pump, the operator has to stand on the base and pull the handle vertically upwards towards his/her chin and then push it down towards his/her feet. This motion requires the operator to either use the muscles in his/her arms and shoulders which quickly become fatigued, or to squat down on every down-stroke and use the muscles in his/her legs to lift the piston on the up-stroke which wastes a lot of energy and is tiring because the operator also has to lift much of his/her own weight on every stroke.

The present invention also has a number of other useful attributes: 1) The pump can comfortably accommodate persons of a wide range of heights—shorter people use the pump with a more acute angle than tall people; 2) The pump provides for a range of different energy input styles to be used. Thus, a user can chose the style according to their personal preference; 3) When a user starts to feel fatigued using one style they can adjust their style to use other muscles.

The invention may be used as a water pump targeted at farmers for low-cost irrigation, a sump pump, a bicycle pump, a car tire pump, sludge pump or any other suitable application. It can be used to pull in and pressurize a gas (as in a bicycle pump) or to pull a fluid from a source below the pump and push it to a location above the pump or to a horizontal location away from the pump (as in a water pump). As a low-cost irrigation pump, the invention will suck water from a source up to 8.5 m deep at sea level, and push water up into a tank over 7 m above the level of the pump. The invention can irrigate crops a hundred meters away from a source that is several meters deep, with an output of over 1000 liters per hour. The pump weighs less than 5 kg[1] and its light weight enhances the ease of moving the invention to a different location.

[1] Average weight of pump without pipes is 4.7 kg.

While the hinge/pivot between the cylinder and base can take on many forms (including a rubber—or other flexible material-component), this particular rendition of the pump reduces the manufacturing cost by having the pivot axle formed by the inlet and outlet pipes of the pump as illustrated in FIGS. 9 and 10. This simplifies the base of the pump considerably; reducing the amount of steel and welding employed, and hence is a notable contributor to the pump's low cost. The wide spacing of the pivots also contributes to the lateral stability of the hinge. The pivots are lined with hard-wearing HDPE pipe to reduce friction and extend the pump's life.

B. Valve Assembly

The Flexible Plastic or Rubber Valves

The flexible valves are designed for using the invention to pump liquids. They are designed to be very easy to install and replace and to work efficiently in a very small and simple valve box. The valve designs are unique due to the reasons claimed below.

Ease of Insertion

Figure 13:
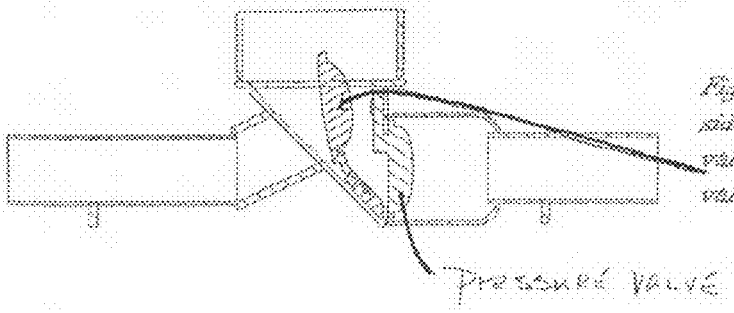

The invention is designed for the user to perform basic maintenance with no special skills or tools required. Furthermore, no special training or skills are needed to install or replace the flexible valves. The flexible valves were made from PVC with sockets which press onto fixed rivets. FIG. 11 shows a view of the valve box with the cylinder removed. FIG. 12 shows the valves themselves from the same view. FIG. 13 shows a side section with the suction valve opening on the upward stroke of the piston.

These flexible valves have the following advantages: 1) No alignment needs to be performed in fitting the valves; 2) The valves can be fitted or replaced by unskilled users; 3) The nature of the valves means that the metal parts of the valve box to which they fit are simple to manufacture—a punched plate with two rivets which are located by punched holes; 4) They can be manufactured at a low-cost and can be made with basic injection molding equipment; 5) The valves can be manufactured from recycled material.

The Back-fitted Pressure Valve

Figure 14:
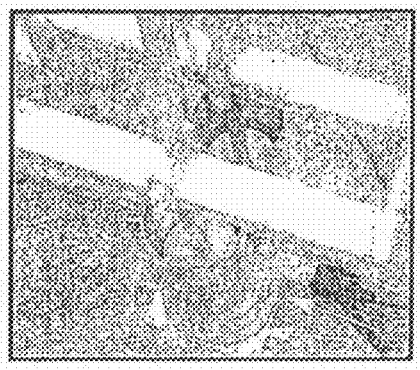
Figure 15:
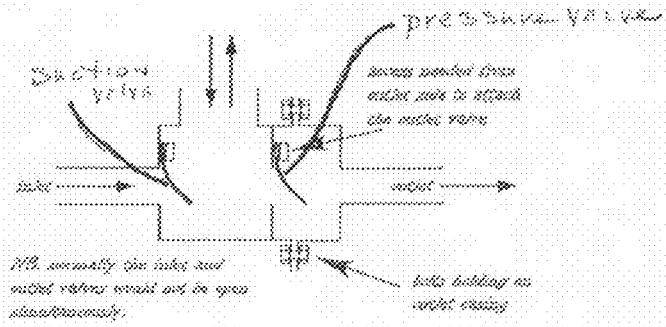

In most designs of pressure water pumps the outlet valve can only be installed or replaced by opening-up the outlet chamber of the valve box. Moreover, it is common that the valve box is opened by unscrewing a cover that is held in place by a number of bolts and sealed with a gasket. (See FIG. 14). This is the case because an outlet valve has to open towards the outlet side of the pump. This is schematically illustrated in FIG. 15. However, using a bolt-on outlet chamber in a pump has disadvantages: 1) Bolts can rust and are an additional expense; 2) The gasket will require regular maintenance; 3) The gasket may leak reducing efficiency which is critical for human-powered pumps; 4) More complex manufacturing methods are needed in order to render the mating surfaces of the valve box flat enough to seal.

Figure 16:
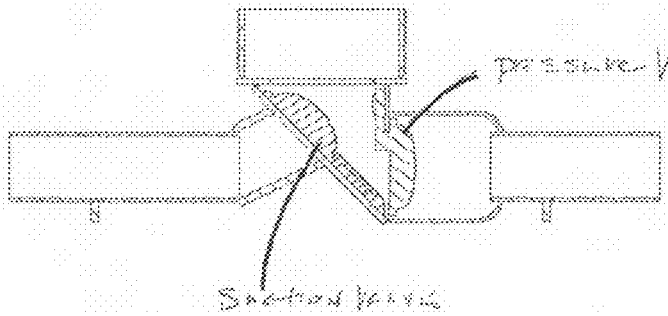
Figure 17:
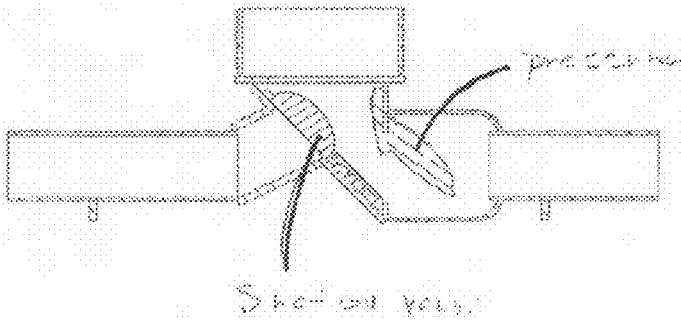

This invention avoids these problems via a novel design of the outlet valve which attaches on the inlet side of the valve chamber, but acts on the outlet side. The design also improves on valve durability and has minimal maintenance needs. The valve attaches to the inlet side of the valve plate in the simple manner described in the first section, using molded sockets and pins. Sections of the motion of the outlet valve are shown in FIGS. 16 & 17. A photograph of the behavior of a prototype of the valve is shown in FIG. 18.

The present configuration of the replaceable plastic part of the outlet valve is shown in FIGS. 19-23. The valve operates by having a flexible stem linking the block, (which incorporates the attachment sockets), to the sealing flap on the other side of the valve plate. The flow of water around the side of the valve means that the total flow area is greater than the area of the hole in the valve plate resulting in an efficient valve design, even with a valve flap opening that is usually less than 45 degrees. This is shown from a photograph from the field trial. (FIG. 24)

Figure 25:
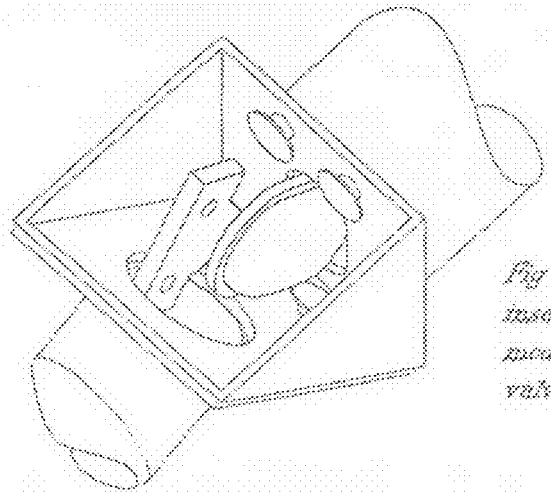

The valve needs to be stiff enough to resist the necessary pressure and yet soft enough to be easily inserted through the hole in the outlet valve plate. The valves of the invention are designed to be oval shaped which meets this design criterion. The valve can be easily inserted through the outlet valve plate as in FIG. 25. By using this method, the entire valve box can be made compact and fully welded, minimizing the volume, minimizing the chance of leaks, and significantly lowering costs.

These two aspects of the outlet valve, the interconnecting stem from inlet valve chamber to outlet valve chamber, and the oval outline, together form the basis of claim 3.

The Valve Box

Figure 26:
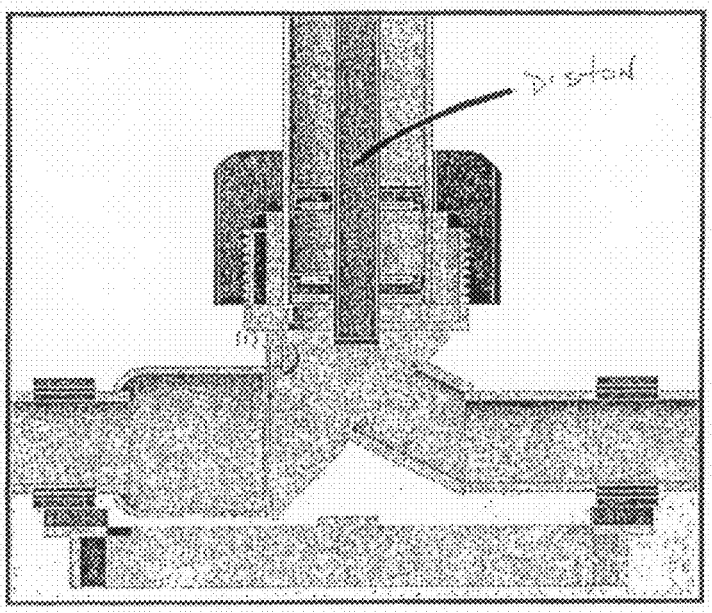
Figure 27:
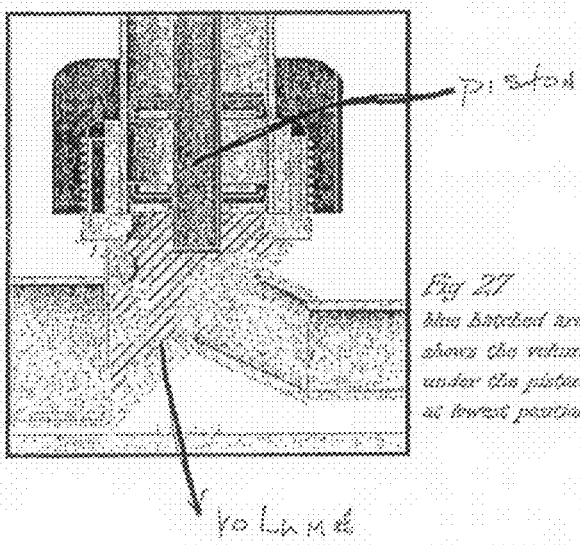

The valve box of the invention is unique in that the valve box has to be physically compact both in order to keep the pump small and lightweight, and to make the pump easy to prime, and yet it has to be large enough to maximize the pumping performance in terms of easy fluid flow through the valves. FIG. 26 shows a section through the valve box when the piston is at the bottom of the stroke. The invention has to have a high "suction ratio" to improve the pump's priming and large valve openings to improve the pump's on-going performance. "Suction ratio" is the ratio of the volume between the piston and the valves when the piston is at the top of its stroke, to the volume between the piston and valves when the piston it is at the bottom of its stroke (see FIG. 27). To have a high suction ratio, the volume of the valve box has to be as small as possible, while to have large valve openings the valve plates have to be as large as possible. In addition for effective priming of the pump, both the inlet and outlet valves have to closed by gravity (or be closed by a spring force) when the pump is operating in the normal operating position. To meet all three of these design criteria in a pump with a small diameter cylinder and piston is a major challenge. The unique V-shape configuration of the pressure and suction plates in this invention solves all these problems. The high suction ratio is possible because the V shape minimizes the volume of the valve box. At the same time, the V shape enables the size of the valve plates and the flow areas of the valves, to be maximized to maximize the flow efficiency. Finally, the sloped and vertical surfaces of the valve plates enable the valves to remain closed by gravity during priming. This unique valve box design also addresses the following design criteria: 1) There is sufficient room to mount both the inlet and outlet valves and easy access to the valves so that they can be easily installed and replaced with no tools; 2) The geometry enables the pressure and suction valves to have enough room to open and close in a small space without interfering with each other, and without restricting the water flow; 3) The valve box has a minimum number of welded seams so it can be easily manufactured; 4) The attachment of the cylinder to the valve box allows the bottom of the piston stroke to be as close as possible to the valve chamber which helps to maximize the suction ratio.

C. The Cylinder Subassembly

The Cylinder Subassembly described here is for an embodiment of the pump designed for pumping fluids. It comprises four components: a removable cylinder, a threaded union for attaching the cylinder to the valve box, a splash cap to prevent fluid that leaks around the piston from splashing the operator, and a cylinder cap with a replaceable bush to guide the piston into the cylinder. The subassembly is designed for low cost manufacture, easy maintenance with no tools required, and to allow for easy priming of the pump.

Cylinder Cap

A flexible plastic cylinder cap fits tightly inside the top of the cylinder and around the stem of the piston so that it guides the piston as the piston goes in and out of the cylinder. The plastic could be one of a variety of flexible plastics, such as PVC. A split in the cap allows the cap to be opened up and closed around the piston stem. (FIG. 28) The lugged cross section of the cap and the flexibility of the material allow the cap to be a firm press fit into the cylinder. The cap, designed with 3 slots, allows fluid to enter into the top of the cylinder for priming the pump without removing the cap.

Cavity for Locating Tab

A tapered tab on the side of the cylinder cap engages in a rectangular slot in the cylinder to secure the cap to the cylinder. (FIG. 28) The cap material must be of a durometer rating firm enough not to distort. This would normally make the tab hard to press in when it is desired to remove the cap. Accordingly, a cavity is formed in the cap behind the tapered tab so that the tab can be easily depressed. (FIG. 29)

Replaceable Liner

The cylinder cap is lined with a plastic pipe with better wear characteristics, such as HDPE, since the cylinder cap plastic material is not wear resistant enough from the sliding piston. (FIG. 30) When the cylinder cap is removed from the cylinder, another liner can be easily affixed into the groove inside the cap. When the cap is in place, the groove in the cap secures the liner which then protects the cap from wear.

Splash Cap

When the cylinder cap is in place, a splash cap (FIG. 31) is slid over the top of the cylinder and the cylinder cap as in FIG. 32. The splash cap is one piece molded plastic.

Removable Cylinder

Figure 35:
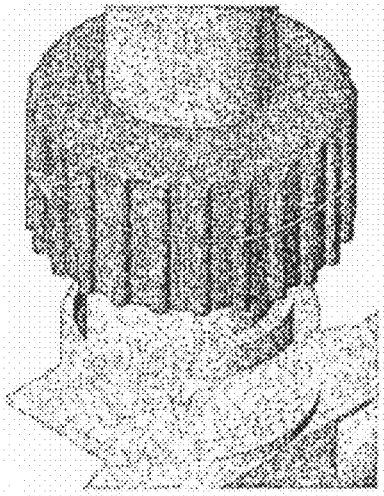

To allow access to the valve box, or to replace the cylinder due to wear, the cylinder attaches by means of a threaded union made from tough plastic. The union screws onto a steel nipple which is integral with the valve body. This is illustrated in FIG. 35.

Figure 33:
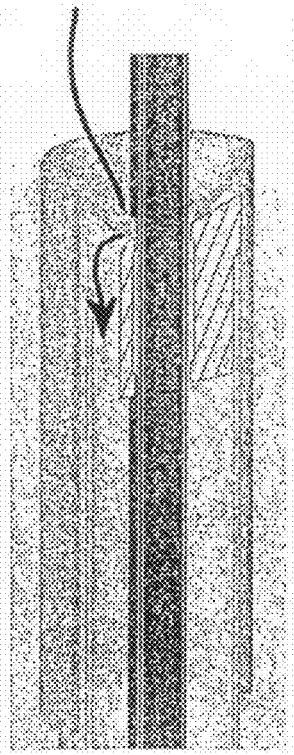

The splash cap and the cylinder cap operate together to perform two functions: ease of priming and the prevention of splashing. When priming the pump, water is poured into the conical recess at the top of the splash cap. It runs through the 1 mm gap between Splash Cap and piston stem and through the array of small holes at the bottom of the conical recess in the top of the splash cap. It then runs down the slots in the cylinder cap and into the cylinder. (See FIG. 33)

Figure 34:
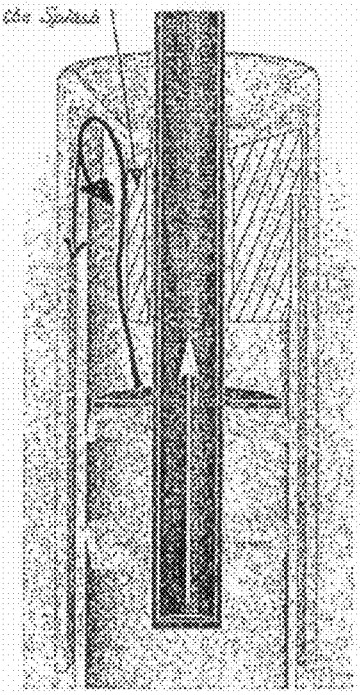

For the pump to operate properly, a small reservoir of water is needed above the piston seals. If the piston is too close to the cylinder cap, this water could be forced out of the top of the cylinder and squirted at the operator's upper body. The relationship of the cylinder cap and the splash cap prevents this from happening. Water passing up through the cylinder cap is directed to the inclined inner surface of the splash cap. (FIG. 34) The inner core of the cylinder cap directs water away from the filling holes in the splash cap. Most of this water is redirected back into the cylinder and water that escapes between the splash cap and the cylinder flows downwards along the outer surface of the cylinder away from the operator's body and feet.

D. The Piston

The piston has two innovative features—opposed piston seals (piston cups) and an automatically closing leak valve that is simple and low cost to manufacture.

Figure 36:
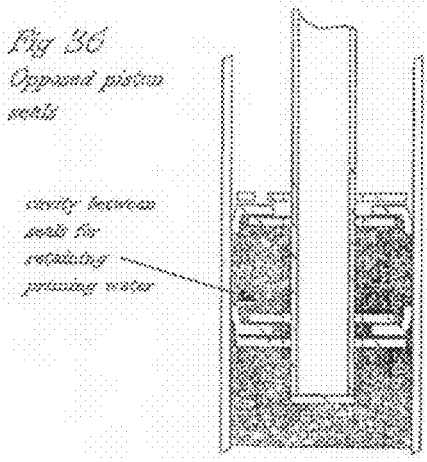

The piston seals (piston cups) are opposed—the pressure seal is mounted above the suction seal. This is shown in FIG. 36. When the piston is pushed downwards, the water easily passes the lower suction seal as the skirt of the seal is pushed inwards. The water is needed over the suction seal in order for the suction seal to work effectively—a dry seal is not effective. However, too much water over the piston is inefficient. The gap between the suction and pressure seals limits the amount of water on top of the upper piston disk—so it limits the amount that leaks out of the top of the cylinder—while at the same time it ensures that there is an adequate amount of water available above the suction seal to ensure good sealing on the upward stroke.

Figure 37:
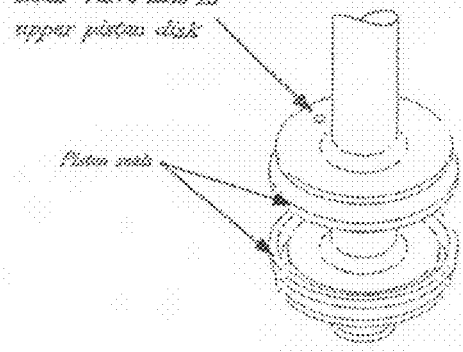
Figure 38:
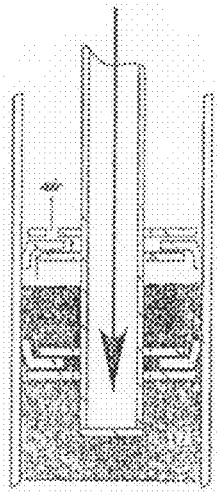
Figure 39:
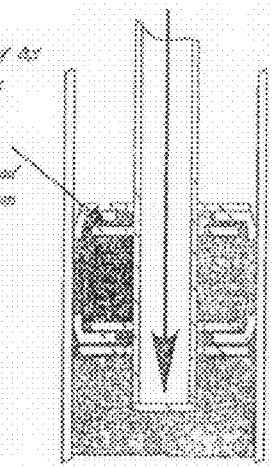
Figure 41:
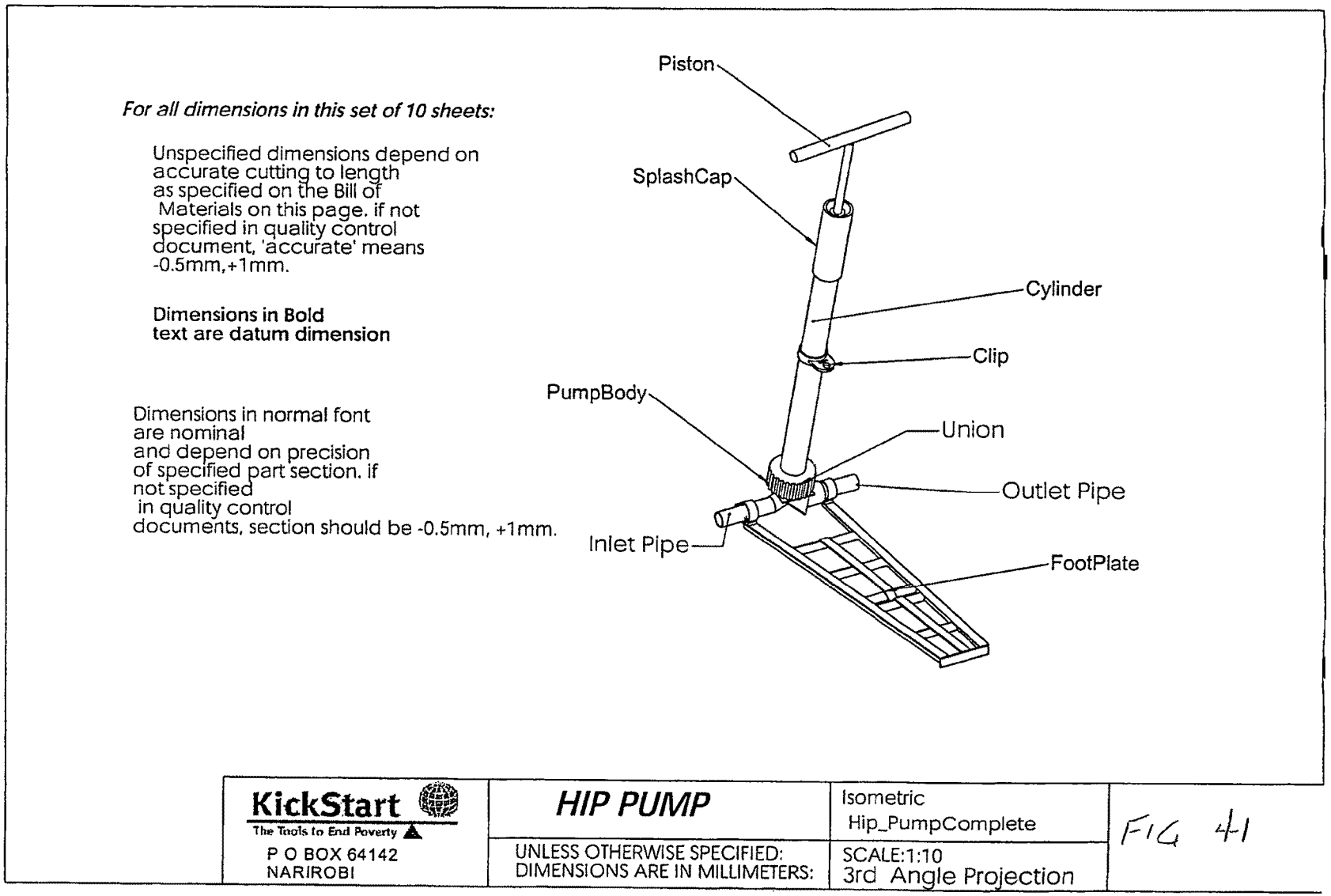
Figure 43:
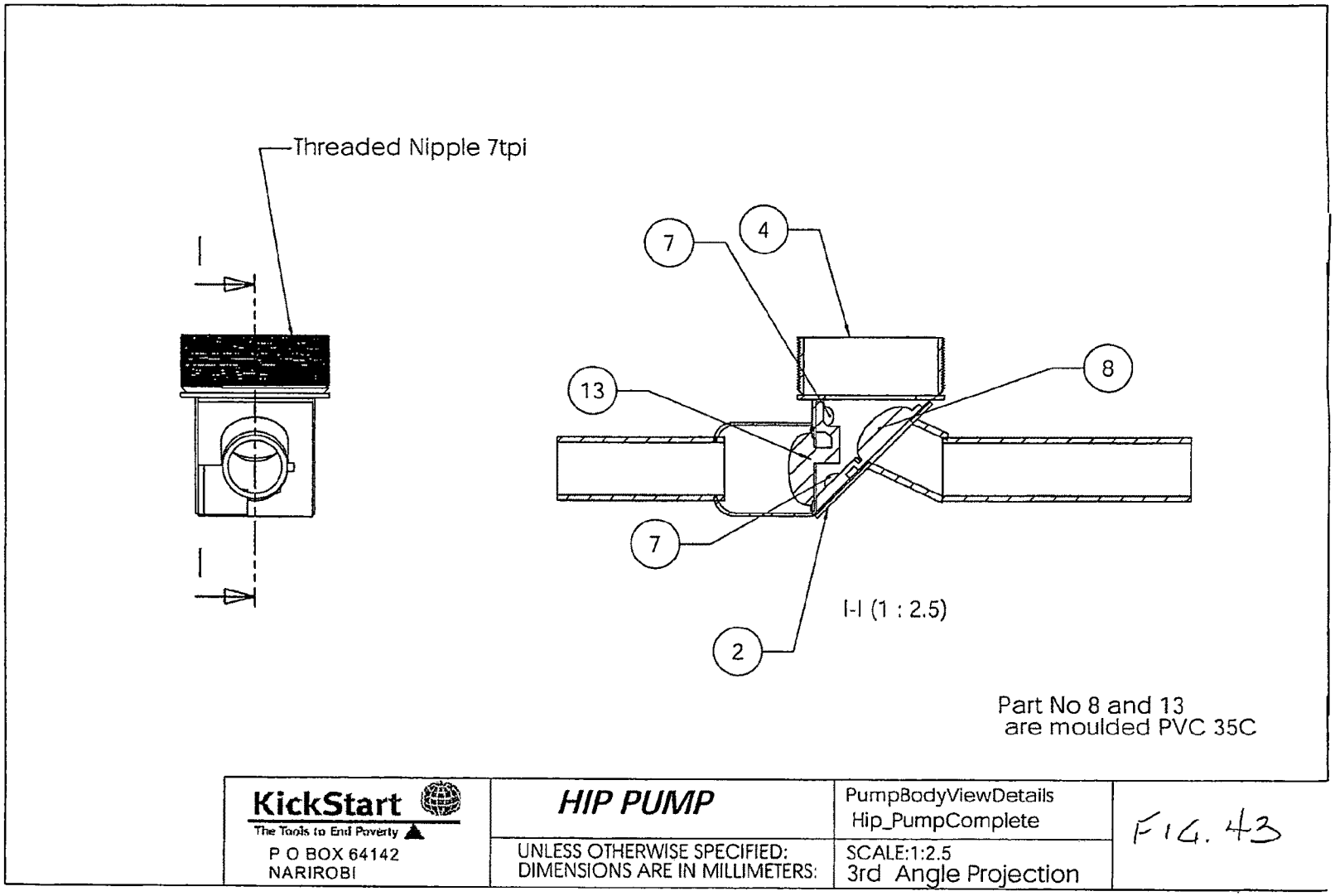
Figure 44:
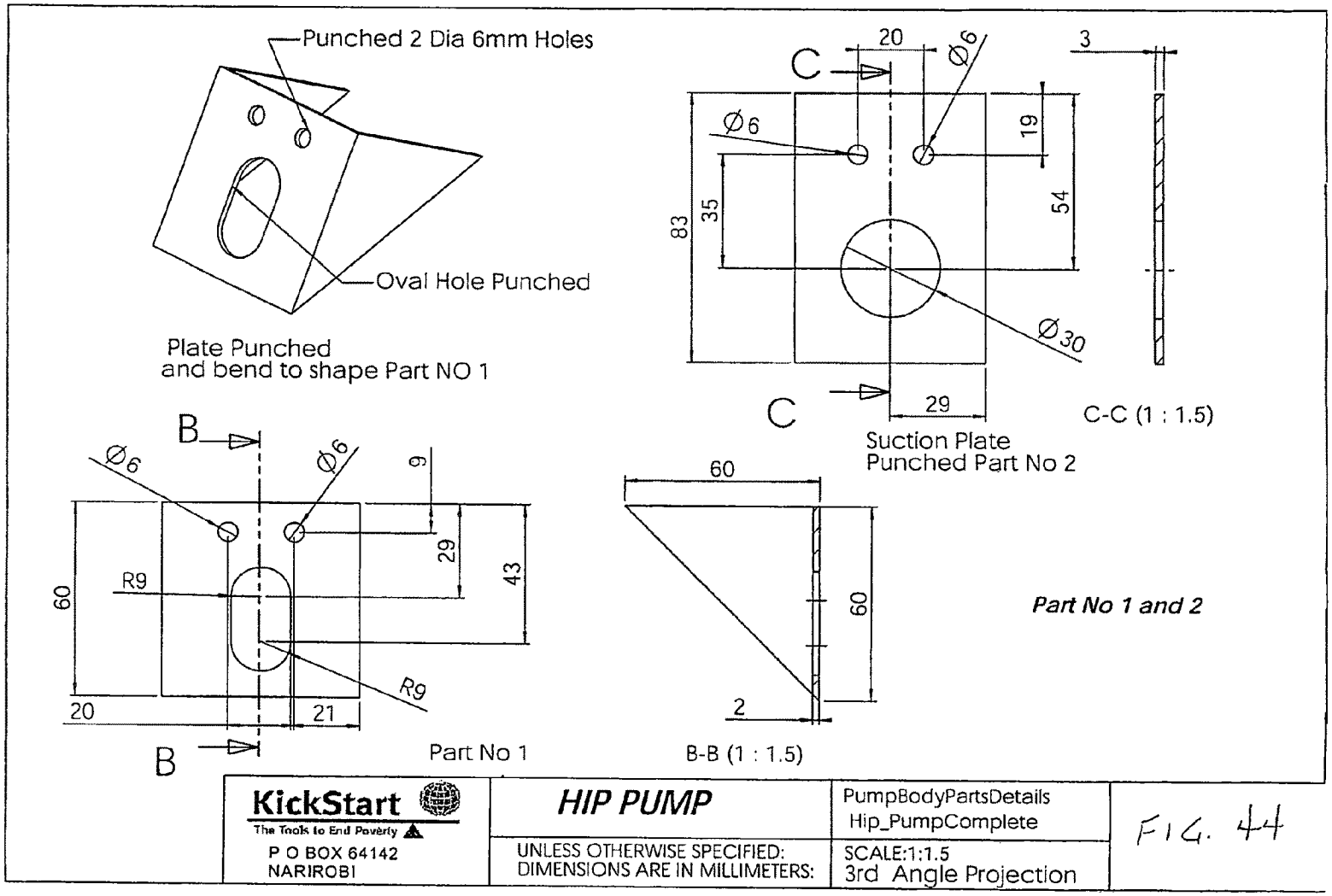
Figure 45:
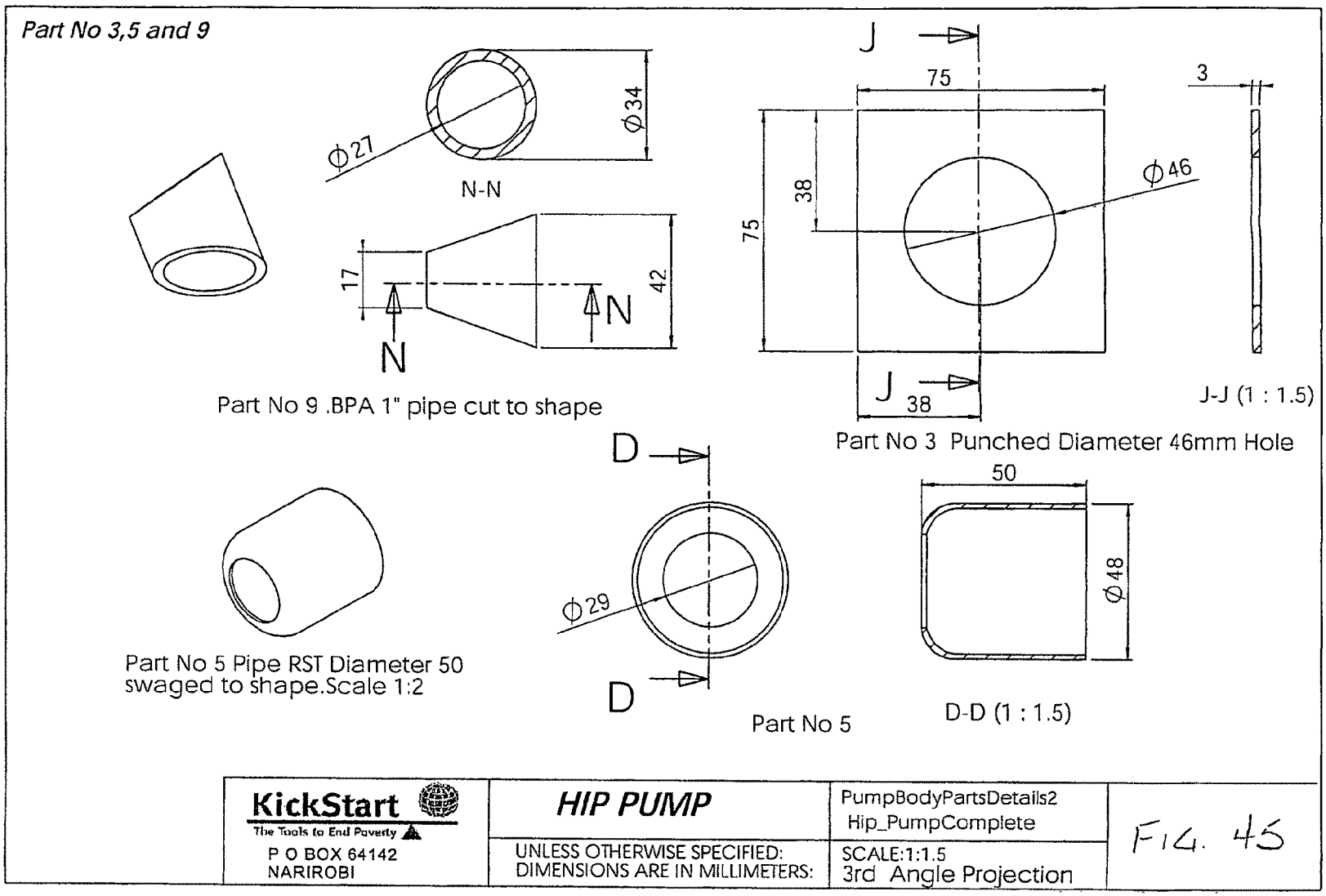
Figure 46:
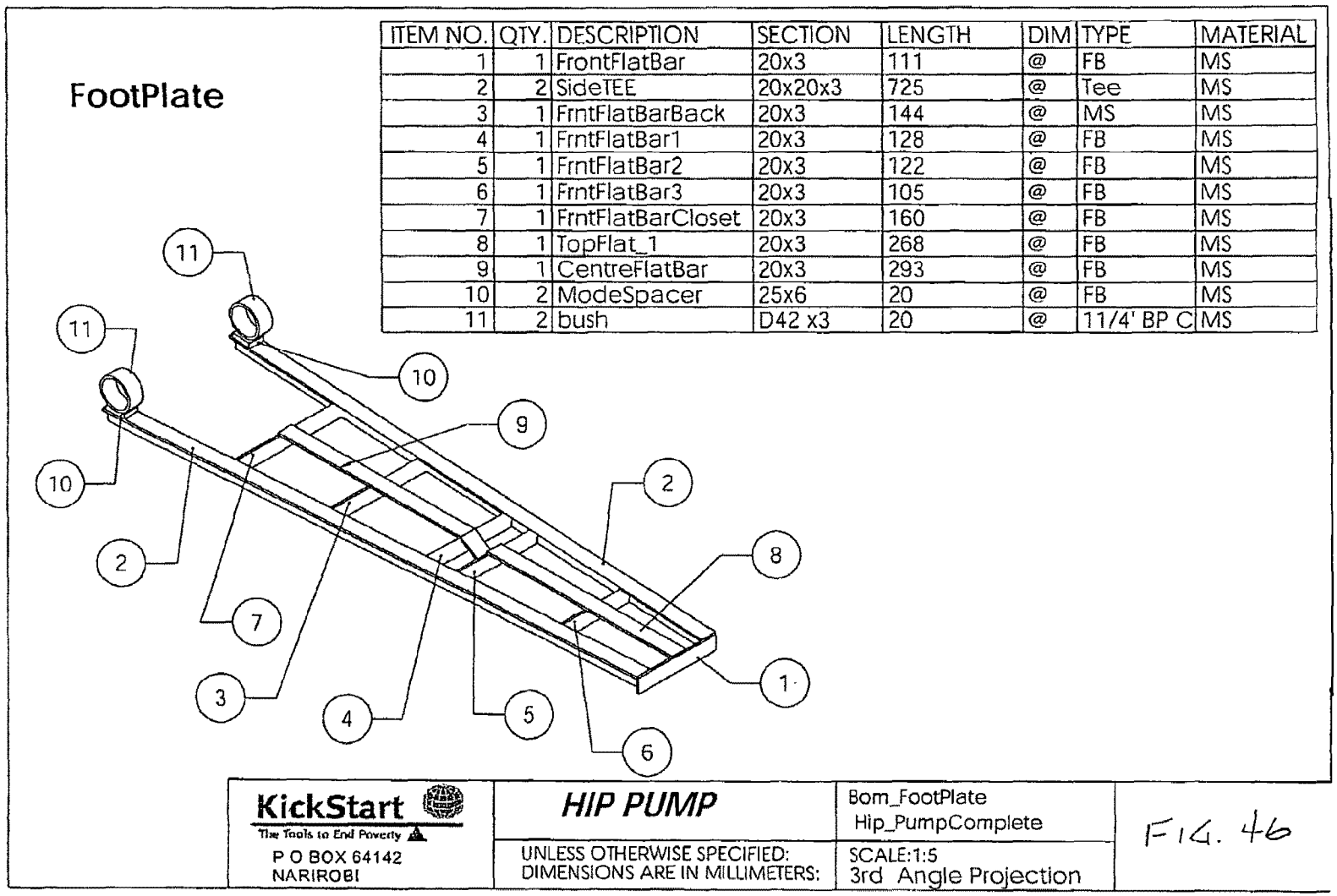
Figure 47:
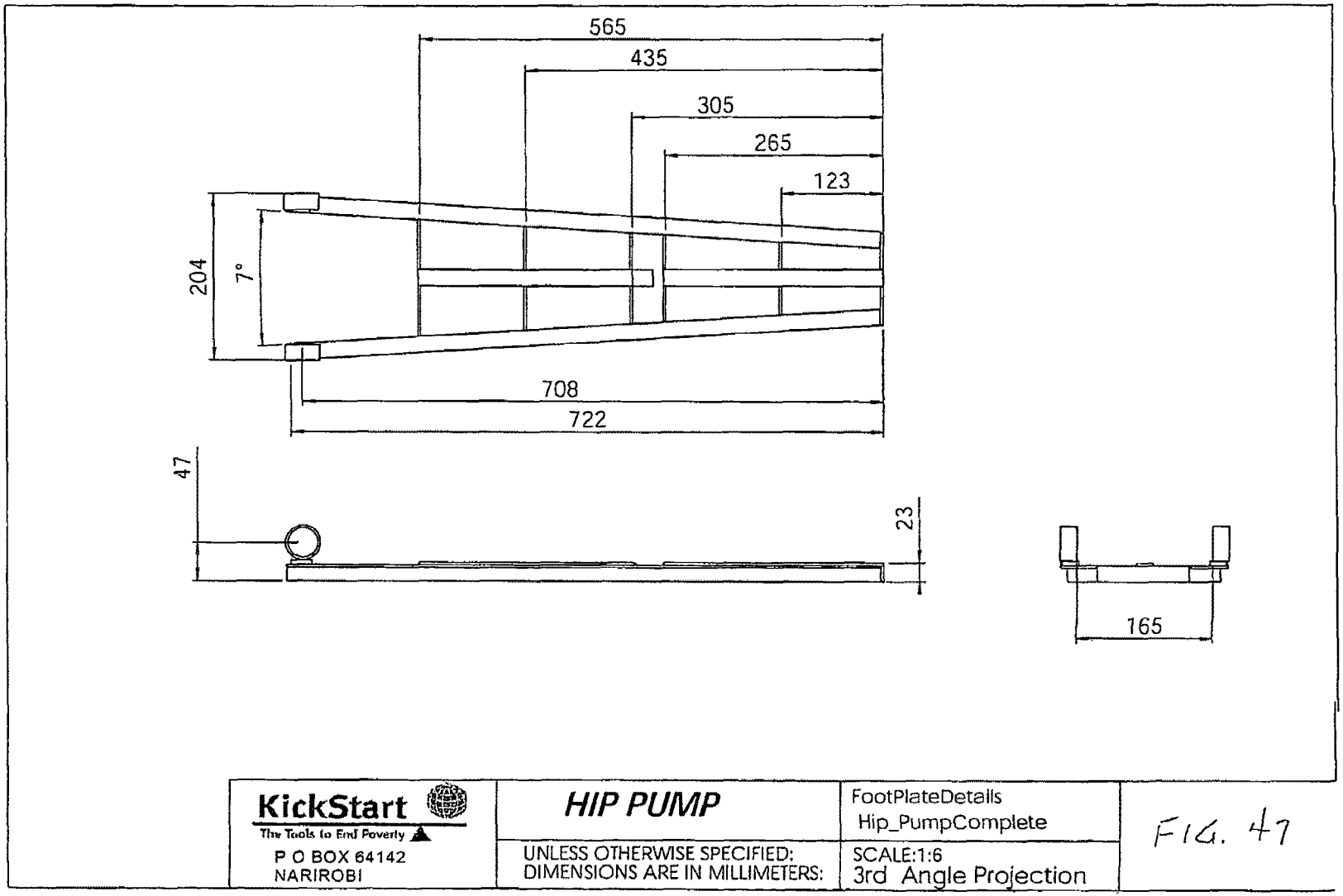
Figure 49:
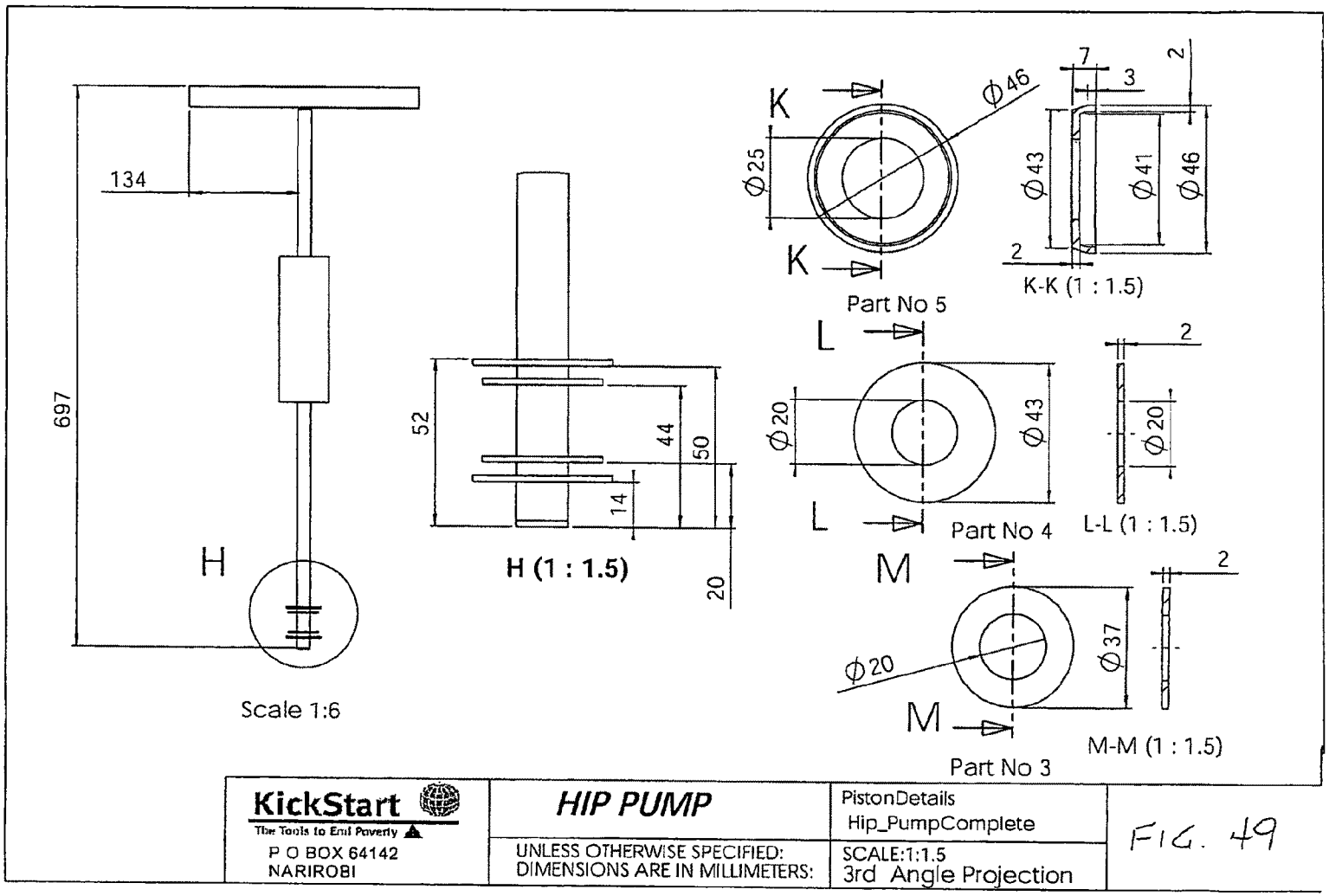
Figure 51:
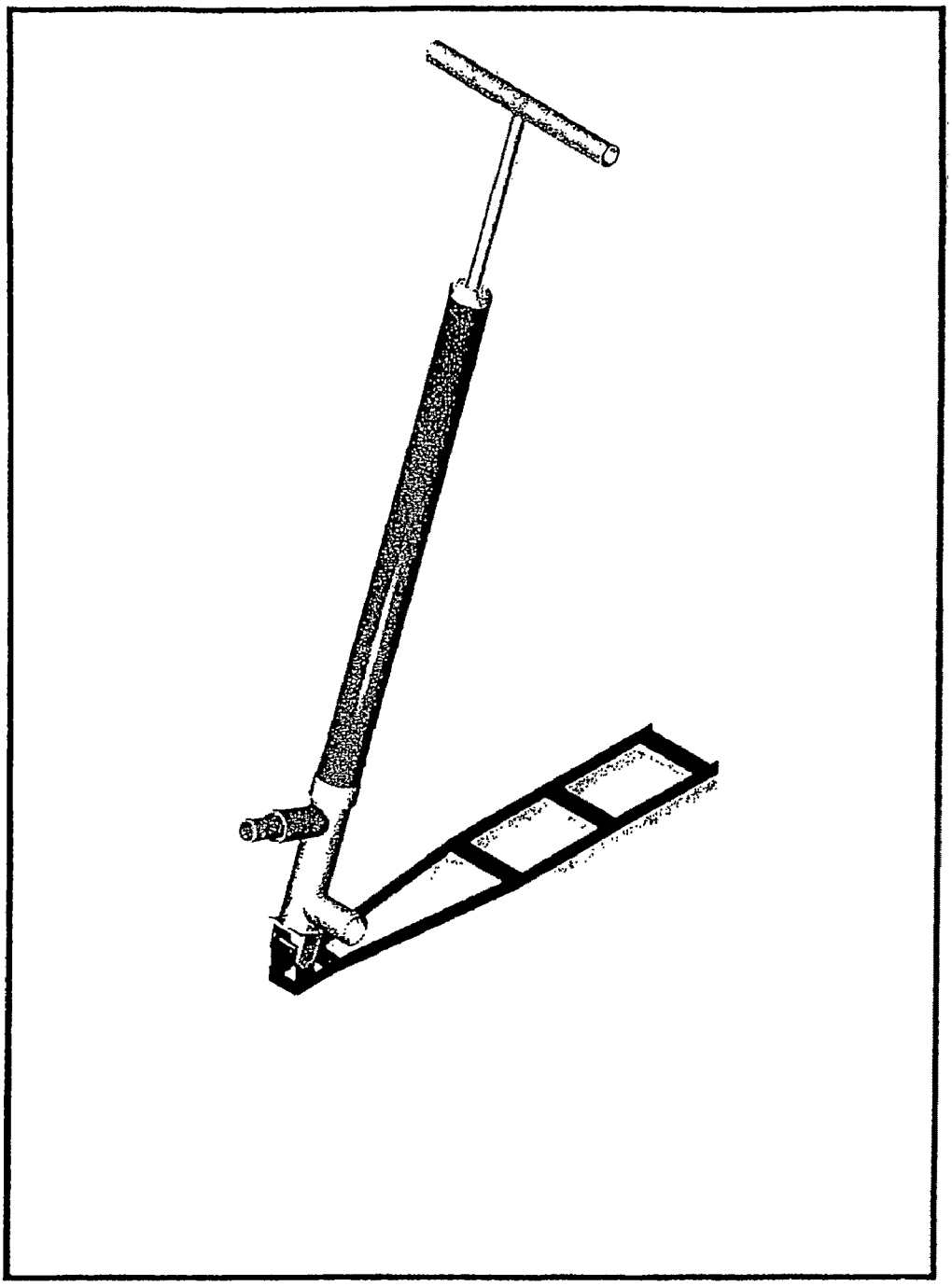

An air gap can form between the opposing seals when priming the pump or when the suction load is far greater than the pressure load. For the efficient functioning of the pump, water is needed above the suction seal on the suction stroke. The design resolves this issue by drilling a small hole (leak valve) through the uppermost piston disk. (FIG. 37) The small hole works in the following manner: 1) When the piston is pushed downwards, water passes by the lower suction seal as the skirt of the lower seal is pushed inwards (FIG. 38). The upper pressure seal allows the passage of air through the leak valve allowing the volume between the seals to be filled with water; 2) When the space has filled with water, the pressure seal is forced upwards onto the uppermost disk as in FIG. 39, thus closing the leak hole, and curtailing the escape of water through the piston.

FIGS. 40-50 depict additional features of the hip pump assembly.

E. Assembly of the Invention

The configuration and detailed construction provided herein and shown in more detail in the various drawings enable the pump to be made inexpensively. The invention is designed for basic manufacturing and does not require highly specialized equipment.

Footplate Assembly

The footplate is made from standard stock flat bar and T section steel, cut to length and welded. The cut parts are placed into a fixture prior to welding which ensures uniformity and speed of production.

Valve Body

The valve body contains pressed/punched steel parts which lower manufacturing time and improve accuracy and alignment in assembly. The parts of the valve body consist of the punched and folded pressure plate, the punched suction plate, and the punched top plate. These parts have holes for the rivets as well as for the passage of water, so that the alignment to the molded PVC valves is simplified. This ensures the critical parts of the valve box are accurate in size and the potential for fabrication error is greatly reduced. As in the case of the footplate, the valve body is welded together in a fixture to improve accuracy and decrease welding time.

Cylinder

The PVC cylinder is glued to the PVC collar at its base, and a hole punched near the top for the cylinder cap.

Handle/Piston

The piston disks and handle bar are welded to the piston stem in a fixture. The leak valve is drilled in the top plate and the molded splash cap is fitted prior to welding.

Bearings

Standard HDPE plastic pipes are cut and split for bearings.

Plastic Moldings

The splash cap can be molded from recycled plastic. The union which attaches the cylinder to the valve box can be molded from polypropylene. The valves, piston seals, cylinder gasket and cylinder clip can be molded in soft PVC.

When all the molded parts and subassemblies are prepared, and painted, the valves are then press fitted by hand into the valve box. The cylinder subassembly is then screwed onto the valve box, with the interposition of the soft PVC gasket. The cylinder clip is slid onto the cylinder body. The piston seals are stretched into the grooves between the piston disks, and the cylinder cap and bearing is clipped onto the piston stem. The piston is then slid into the cylinder and the cylinder cap clipped into place.

II. FIGS. 51-68

Figure 53:
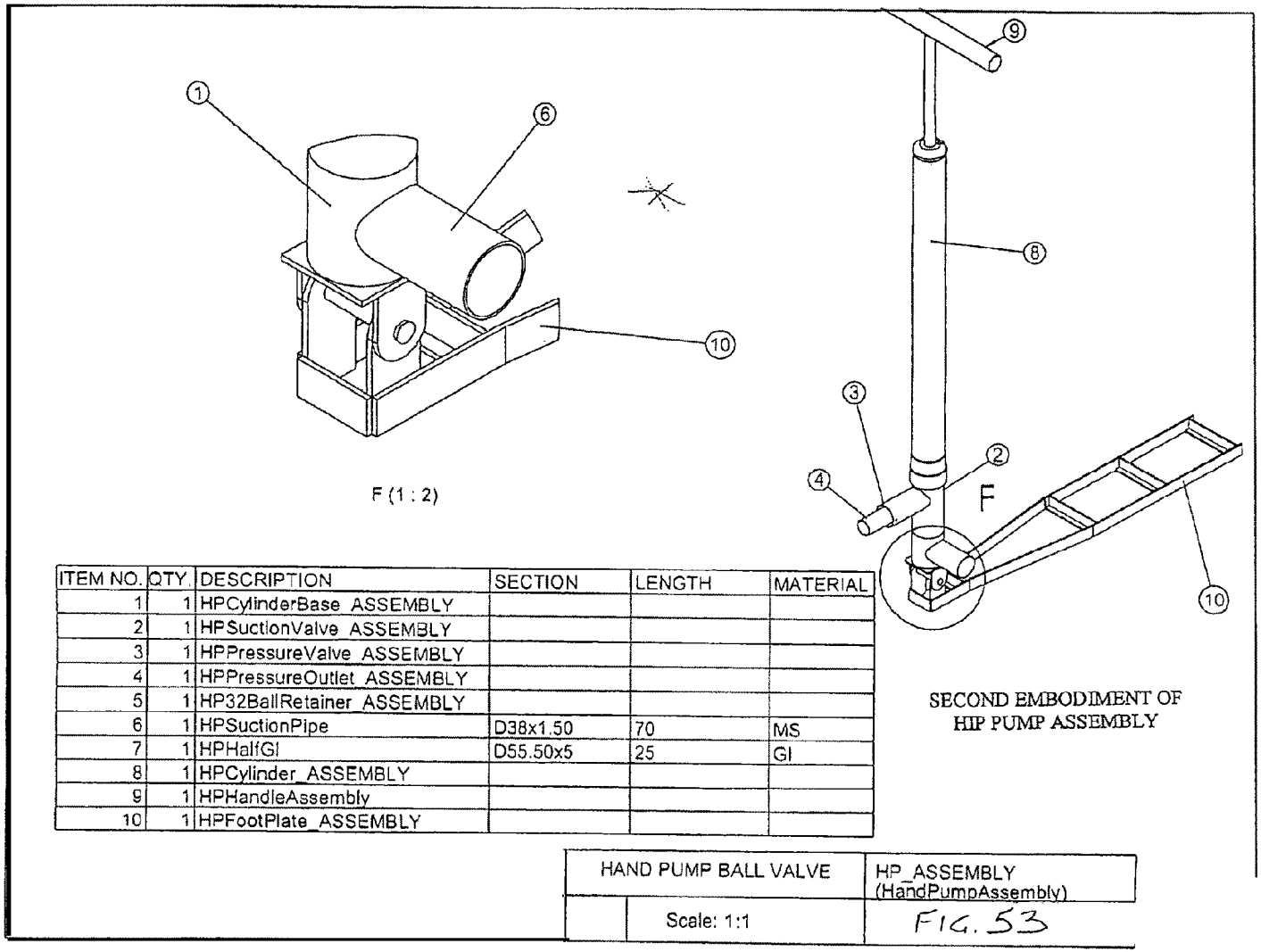
Figure 54:
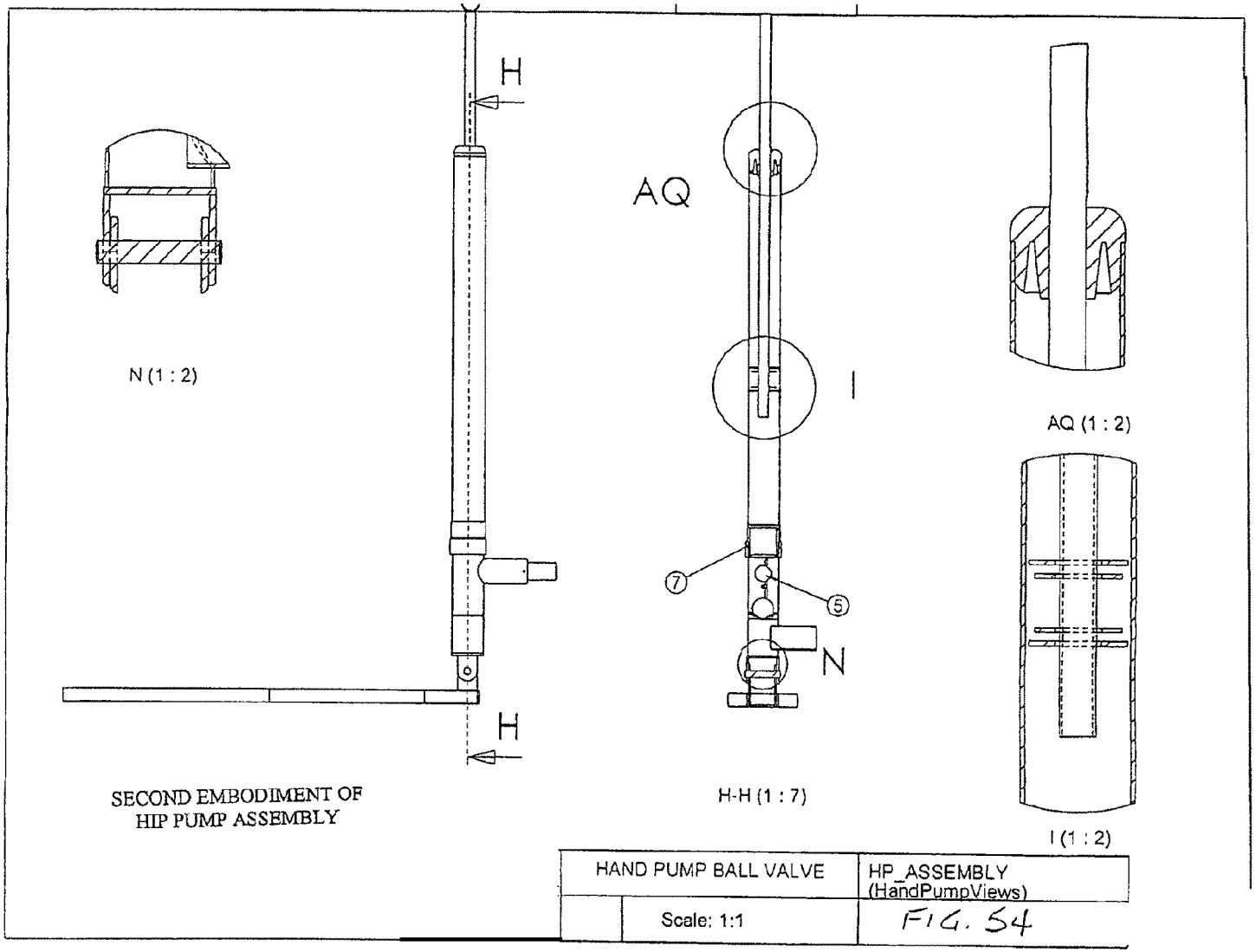
Figure 5B:
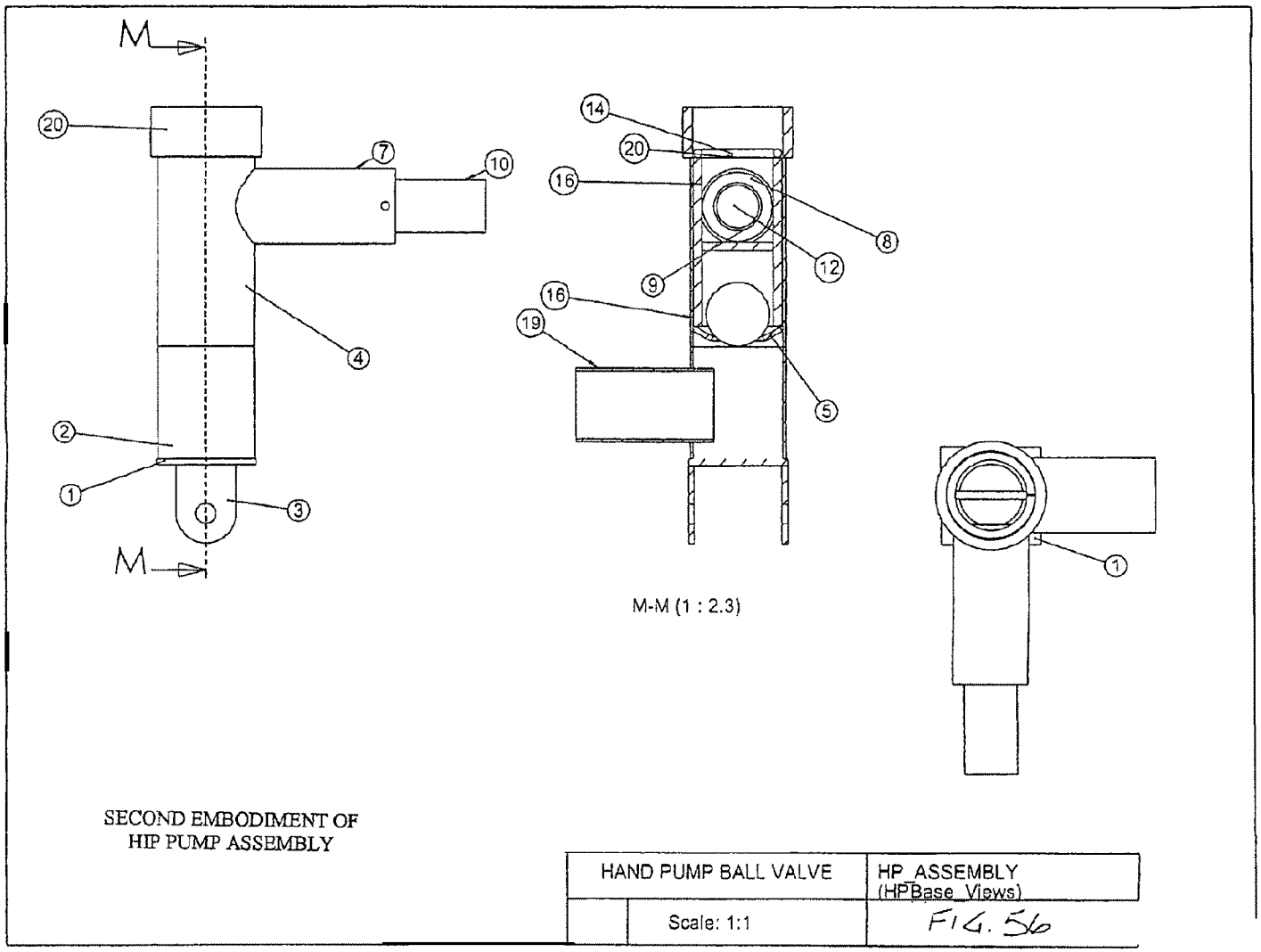
Figure 57:
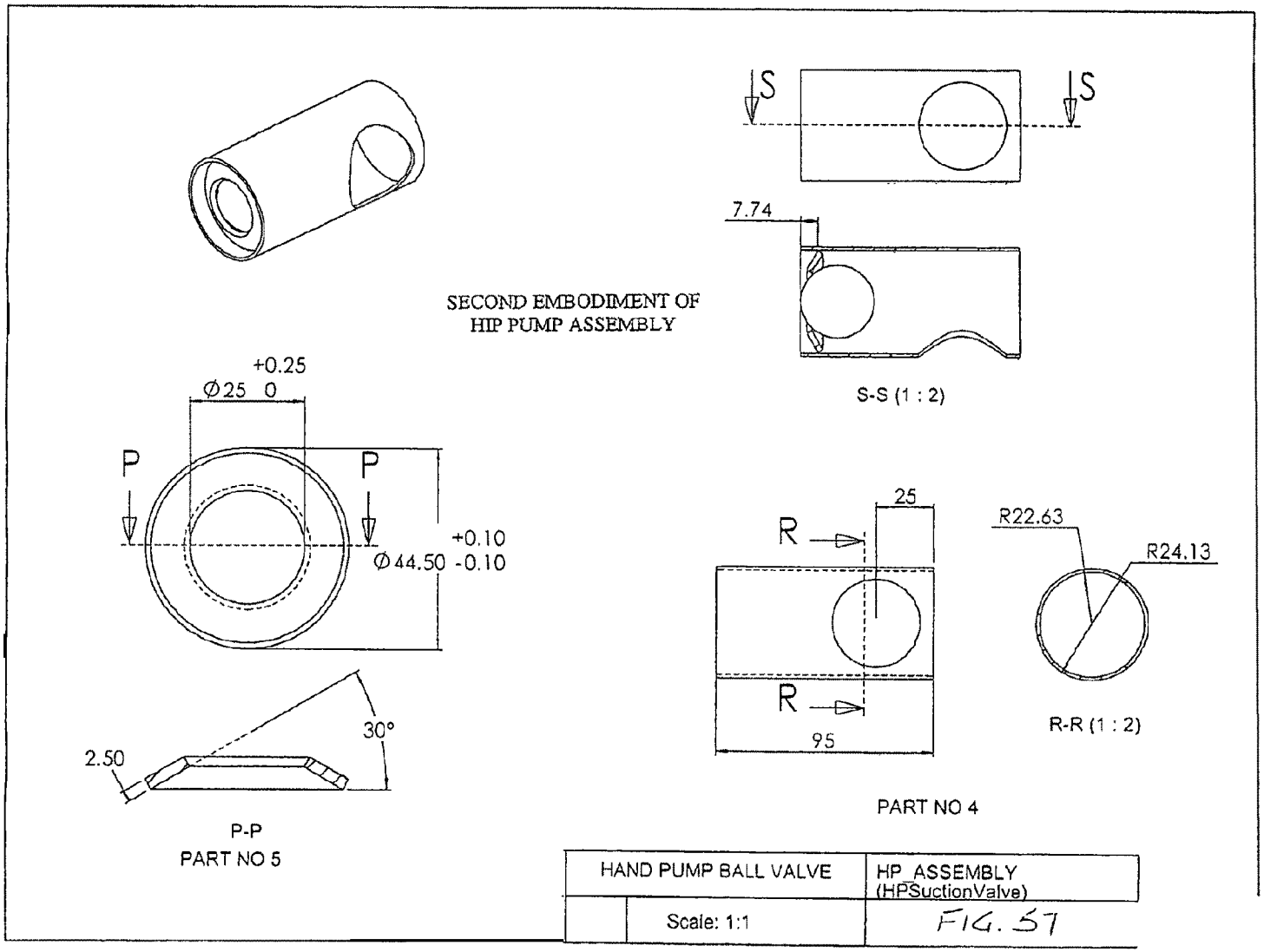
Figure 58:
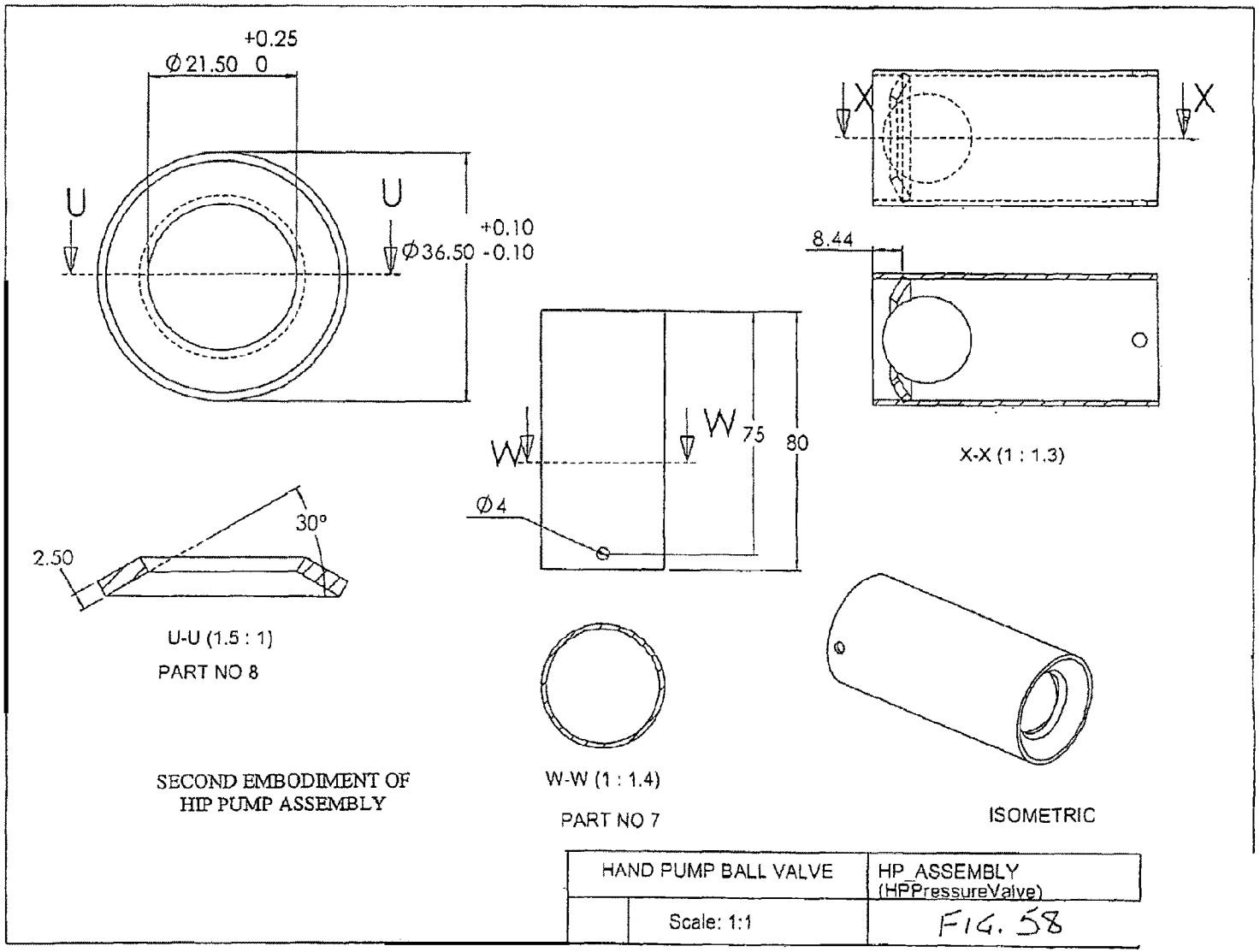
Figure 59:
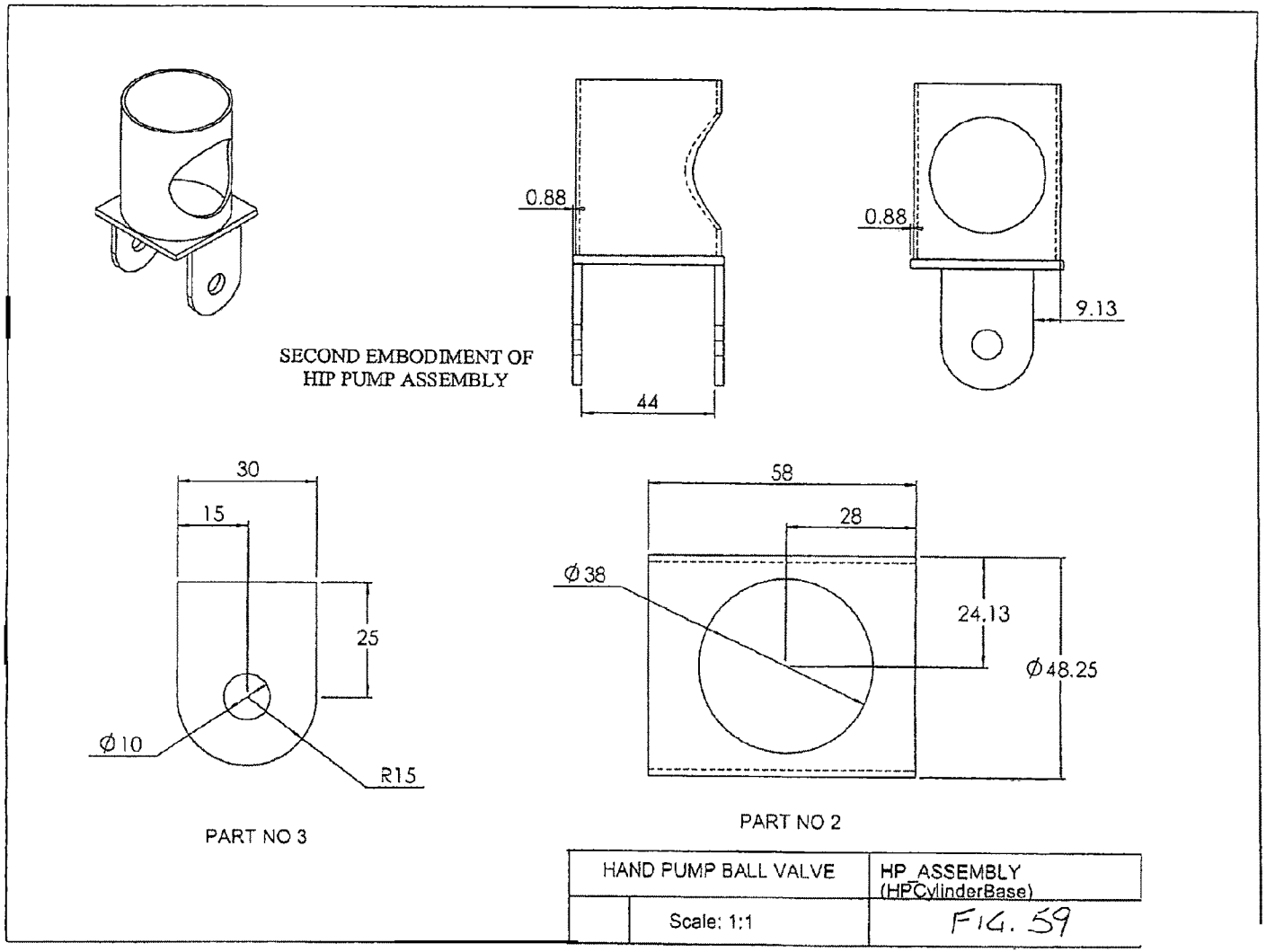
Figure 60:
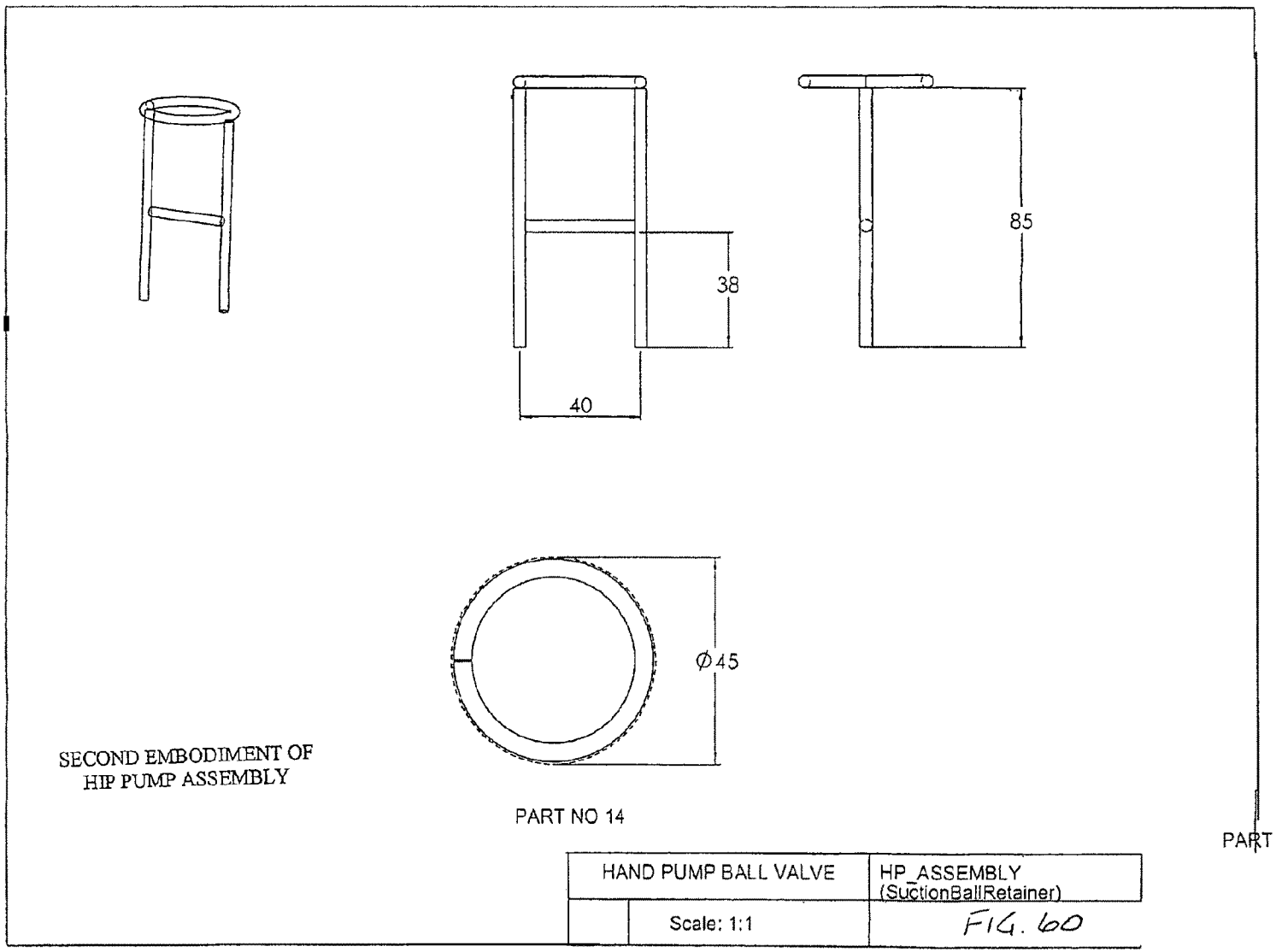
Figure 61:
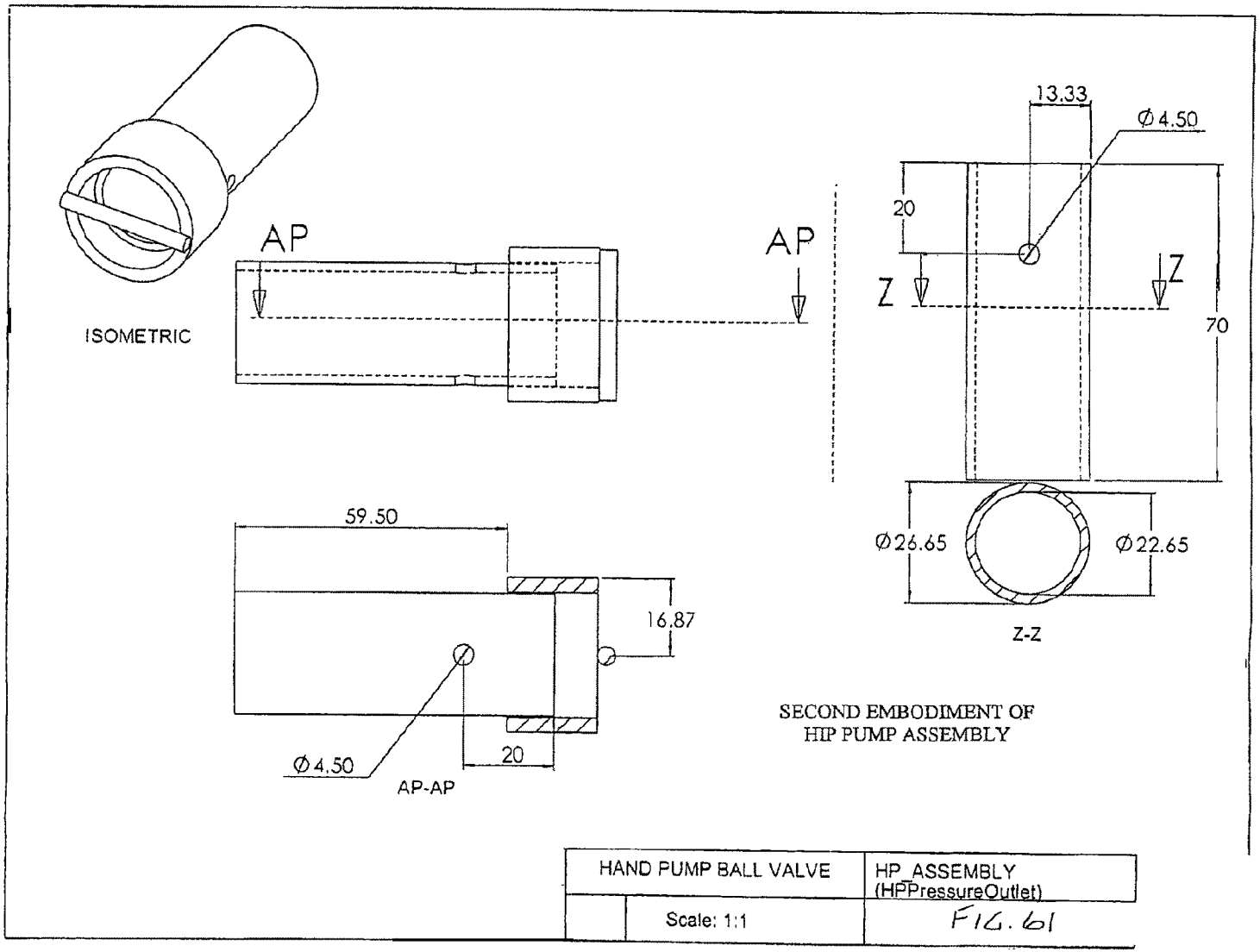
Figure 62:
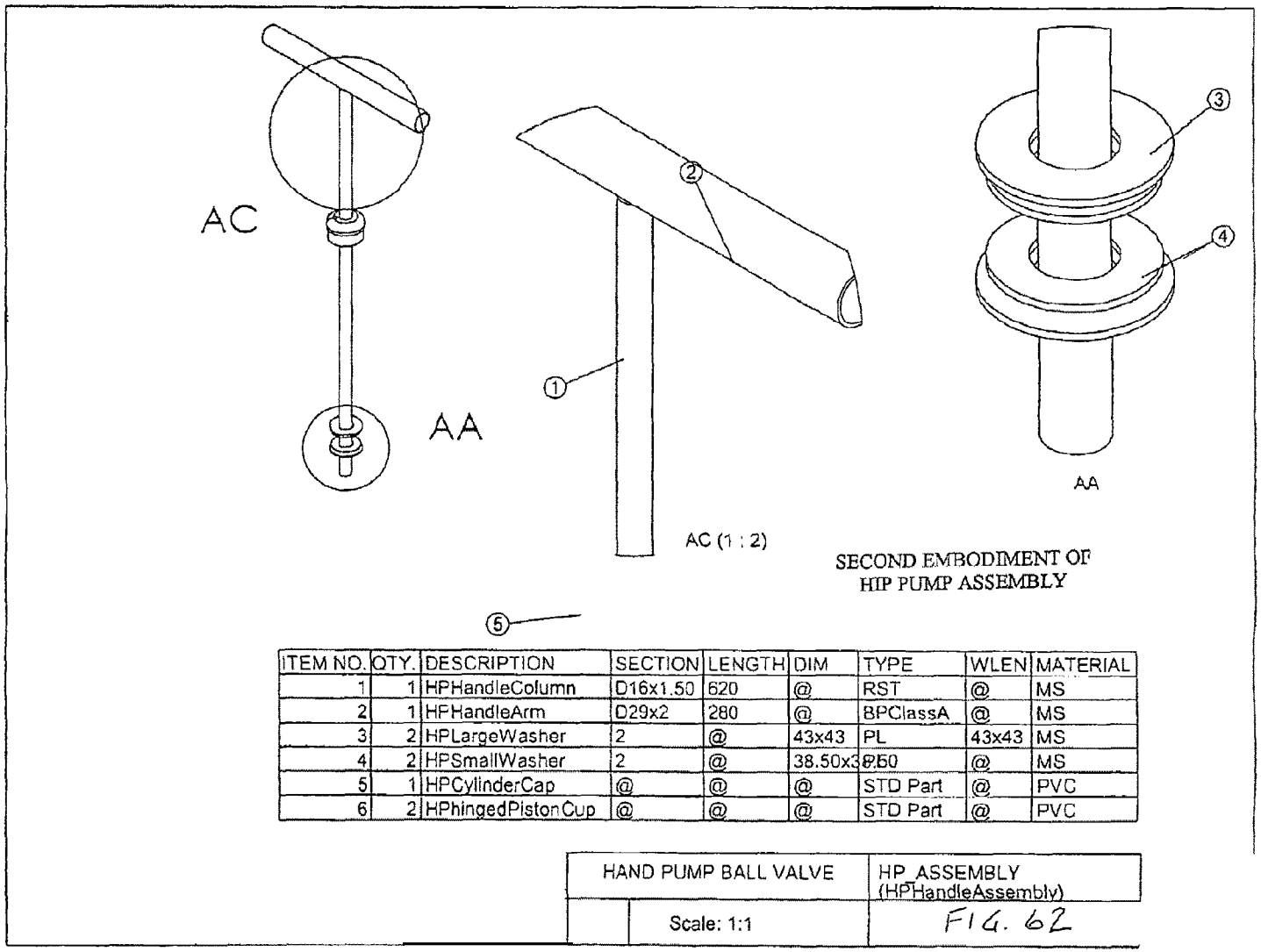
Figure 63:
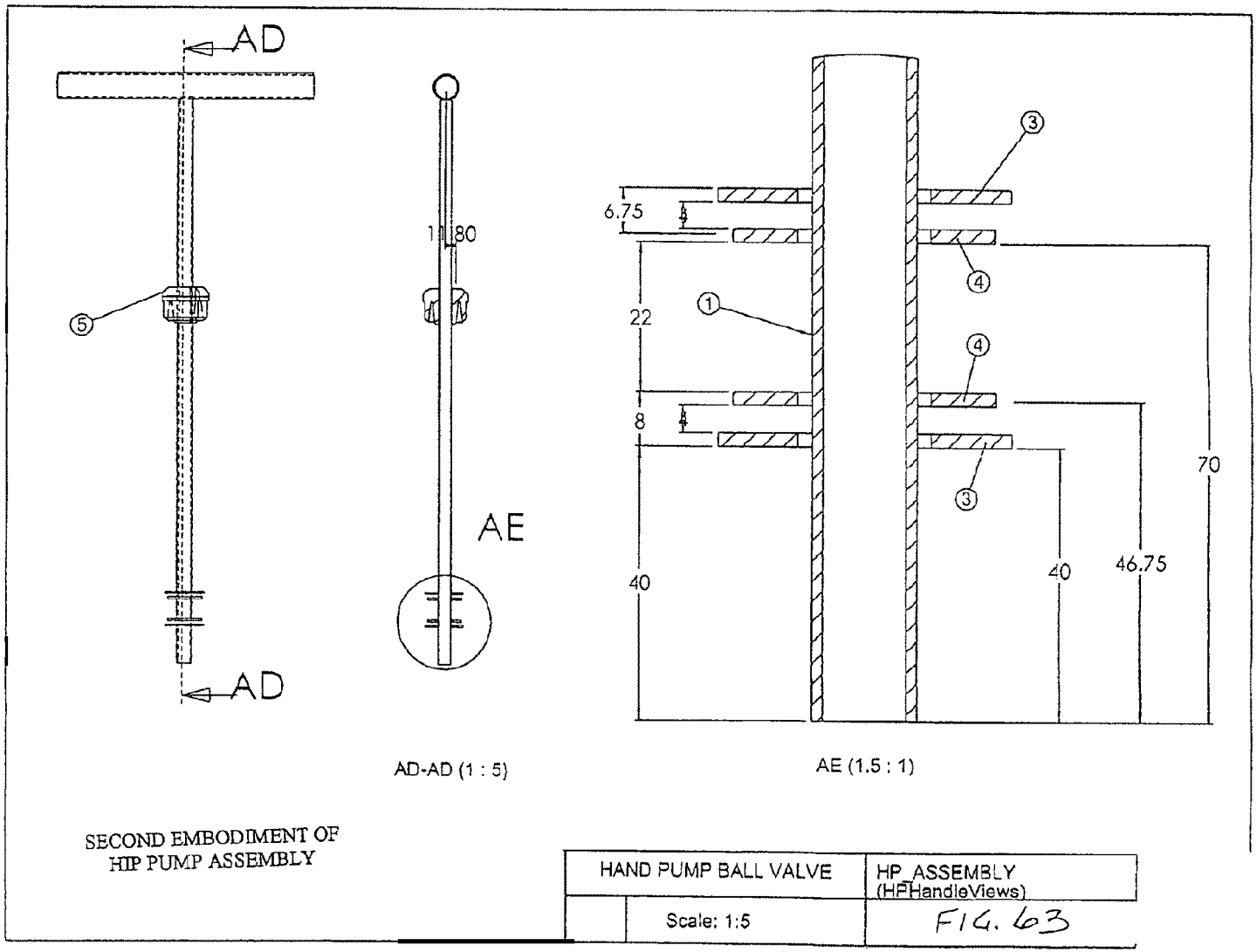
Figure 64:
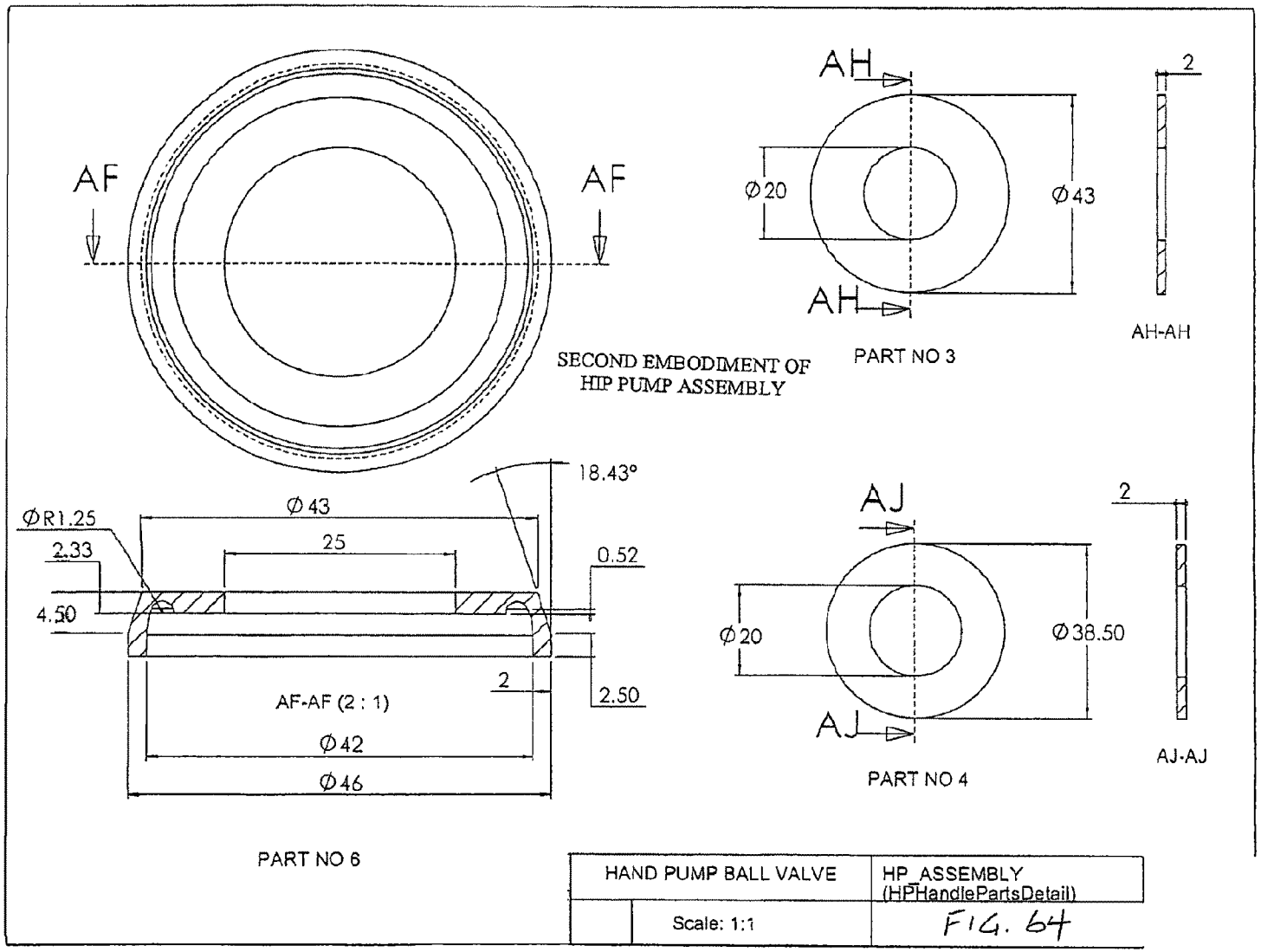
Figure 65:
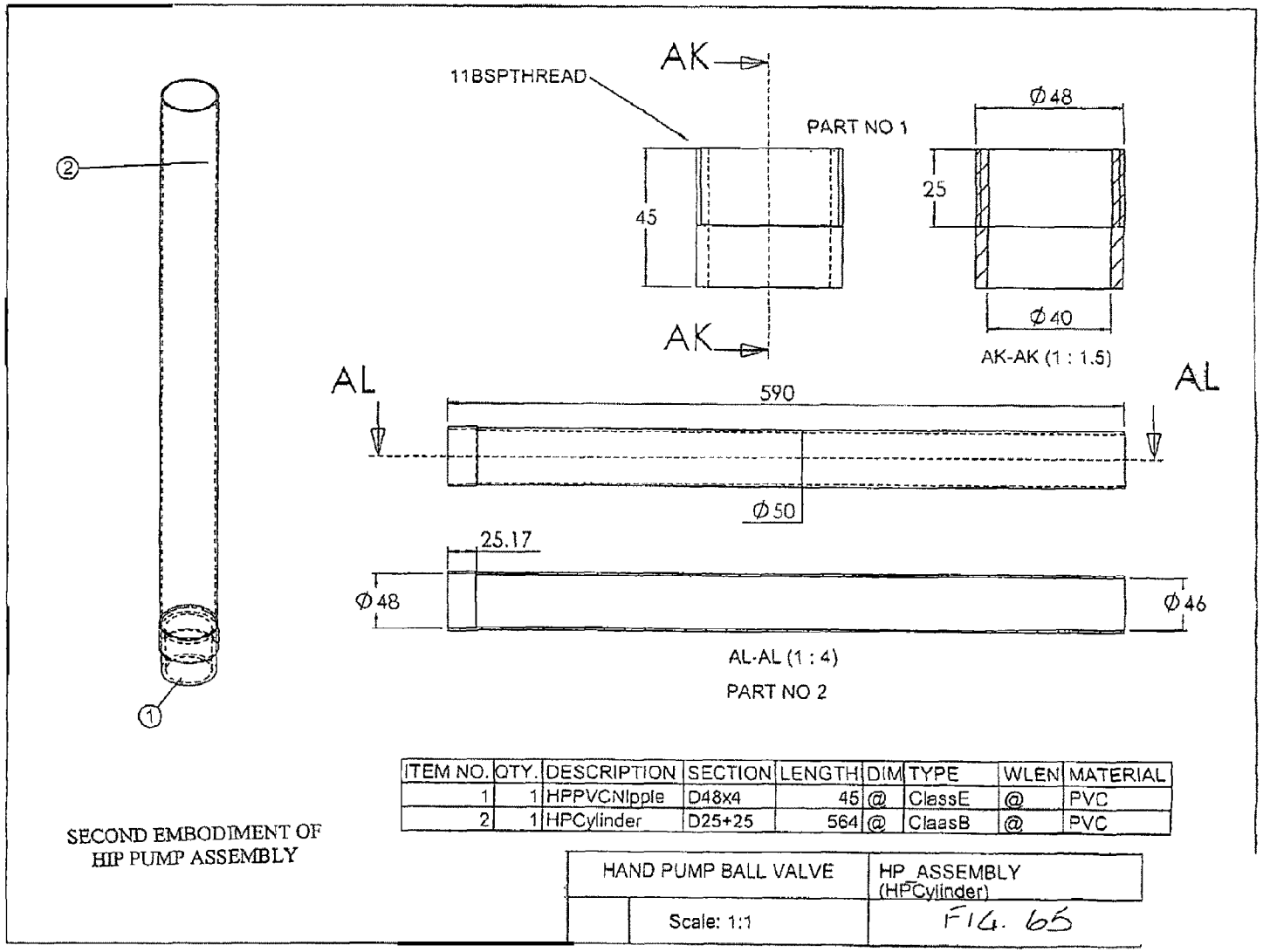
Figure 66:
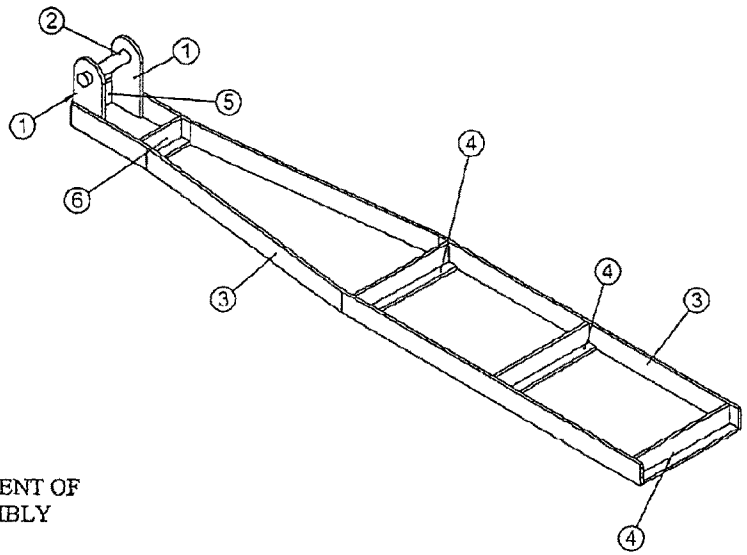
Figure 67:
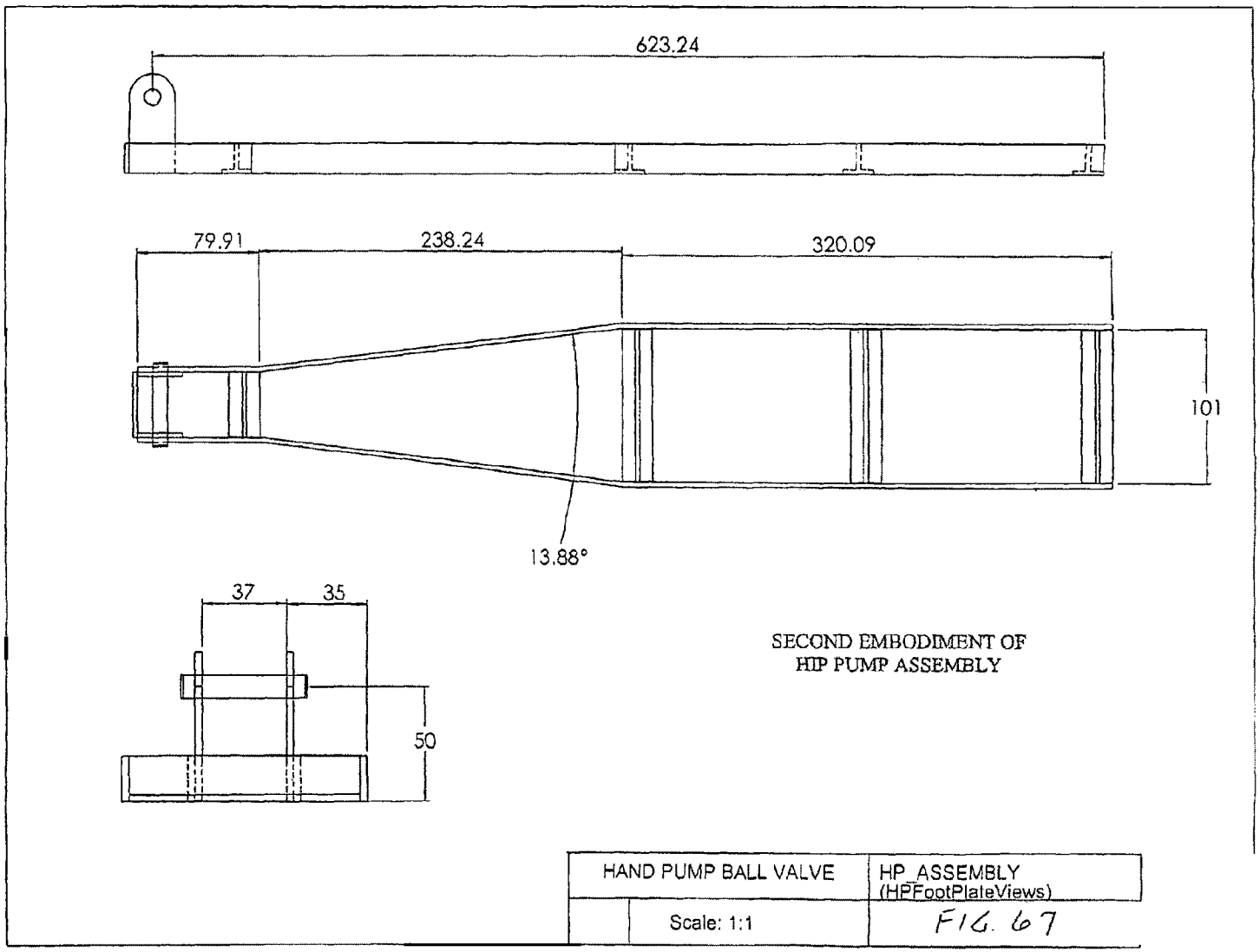
Figure 68:
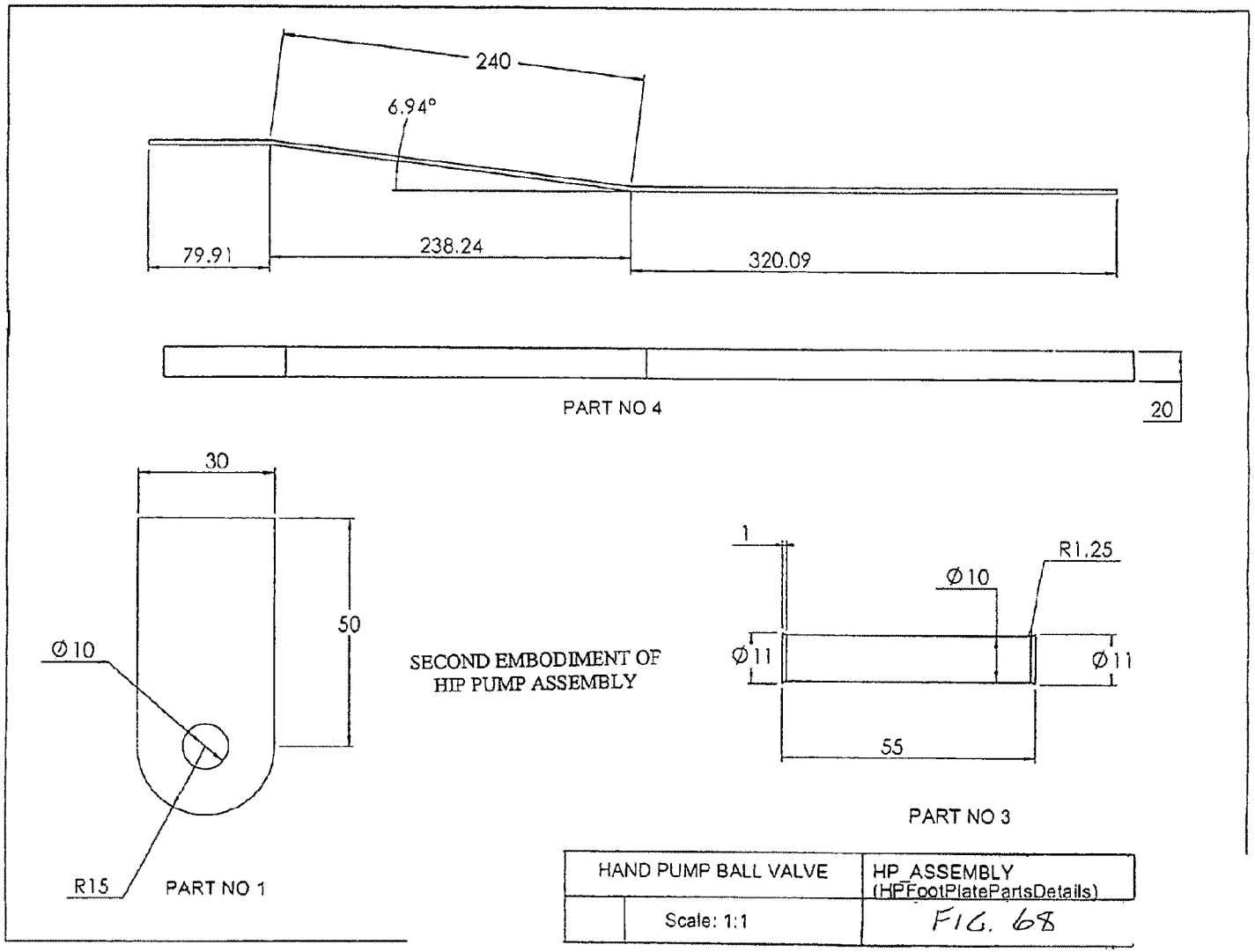

FIGS. 51-68 depict an alternative embodiment of the hip pump assembly of the present invention. Unlike the embodiment discussed above, in this embodiment the assembly includes an independent hinge or pivot between the cylinder and base. The inlet and outlet pipes are arranged as shown in FIG. 53. Other common and distinct features are provided in the drawings.

What is claimed is:

1. An ergonomic hip pump apparatus, comprising:

a base;

a valve box assembly disposed adjacent to the base, the valve box assembly comprising:

a valve chamber having an inlet side and an outlet side, an inlet pipe connected to the inlet side of the valve chamber, an outlet pipe connected to the outlet side of the valve chamber, an inlet suction valve disposed within the valve chamber and adapted for controlling fluid flow through the inlet side, and an outlet pressure valve disposed within the valve chamber and proximate to the inlet side of the valve chamber and adapted for controlling fluid flow through the outlet side and arranged in a v-shaped configuration with the suction valve;

a cylinder assembly hinged off the base, the cylinder assembly comprising:

a removable cylinder coupled at one end to the valve box assembly, a cylinder cap having a replaceable inner liner and disposed within a top portion of the removable cylinder, and a splash cap positioned over the cylinder cap and the removable cylinder; and a piston disposed within the cylinder assembly, the piston comprising:

a pressure seal and a suction seal disposed at a lower end of the piston, the pressure seal being spaced apart and mounted above the suction seal, and a leak valve comprising an opening in the pressure seal adapted to enable fluid flow above the suction seal on a suction stroke, wherein the cylinder cap surrounds the piston, and the base is pivotably connected to the inlet and outlet pipes of the valve box assembly to form a pivot axle between the cylinder assembly and the base.

2. The apparatus of claim 1 wherein the pressure and suction valves comprise polyvinyl chloride.

3. The apparatus of claim 1 wherein the removable cylinder is coupled to the valve assembly via a threaded union.

4. The apparatus of claim 3 wherein the union comprises polypropylene.

5. The apparatus of claim 1 wherein the piston includes a handle at an upper end thereof.

6. The apparatus of claim 1 wherein the pressure and suction seals comprise polyvinyl chloride.

* * * * *